US010254676B2

(12) United States Patent
Chang et al.

(10) Patent No.: US 10,254,676 B2
(45) **Date of Patent: *Apr. 9, 2019**

(54) CHARGE ROLLER FOR ELECTROGRAPHIC PRINTER

(71) Applicant: HEWLETT-PACKARD DEVELOPMENT COMPANY, L.P., Fort Collins, CO (US)

(72) Inventors: Seongsik Chang, Palo Alto, CA (US); Thomas Anthony, Palo Alto, CA (US); Michael H. Lee, Palo Alto, CA (US); Omer Gila, Palo Alto, CA (US); Anthony William McLennan, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/243,311

(22) Filed: Aug. 22, 2016

(65) Prior Publication Data

US 2017/0045838 A1 Feb. 16, 2017

Related U.S. Application Data

(63) Continuation of application No. 14/437,295, filed as application No. PCT/US2012/060224 on Oct. 15, 2012, now Pat. No. 9,423,717.

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; Y10T 29/49117
USPC ..... 399/176
See application file for complete search history.

(56) References Cited

U.S. PATENT DOCUMENTS

| | | | | |
|---|---|---|---|---|
| 5,305,177 A | | 4/1994 | Fumitaka | |
| 5,464,721 A | | 11/1995 | Shigeru | |
| 5,596,395 A | * | 1/1997 | Sawamura | G03G 15/0216 361/221 |
| 5,600,414 A | * | 2/1997 | Hyllberg | G03G 15/0233 361/225 |
| 5,609,553 A | * | 3/1997 | Hyllberg | B41F 13/18 29/895.32 |
| 5,742,880 A | | 4/1998 | Masaaki | |
| 5,778,775 A | | 7/1998 | Schafer | |
| 5,839,029 A | * | 11/1998 | Kataoka | G03G 15/0233 399/115 |

(Continued)

FOREIGN PATENT DOCUMENTS

| | | |
|---|---|---|
| CN | 1165983 | 11/1997 |
| CN | 200950209 | 9/2007 |

(Continued)

OTHER PUBLICATIONS

European Search Report, dated Jul. 23, 2015, in related EP application 12875805.9-1560 /2845056.

(Continued)

*Primary Examiner* — Susan S Lee
(74) *Attorney, Agent, or Firm* — Dicke Billig & Czaja PLLC

(57) ABSTRACT

A charge roller includes a body having a metal external surface and an inorganic outer resistive coating.

15 Claims, 10 Drawing Sheets

(56) References Cited

U.S. PATENT DOCUMENTS

| | | | | |
|---|---|---|---|---|
| 6,070,033 | A | 5/2000 | Hiraoka | |
| 6,226,483 | B1 * | 5/2001 | Kazakos | G03G 15/0818 399/266 |
| 6,359,638 | B1 | 3/2002 | Tomoya | |
| 6,620,476 | B2 | 9/2003 | Tarnawskyj | |
| 7,050,742 | B2 | 5/2006 | Gila et al. | |
| 7,184,676 | B2 | 2/2007 | Ota | |
| 7,395,011 | B2 | 7/2008 | Tanaka | |
| 7,493,063 | B2 | 2/2009 | Takuma et al. | |
| 7,583,914 | B2 | 9/2009 | Hatakeyama et al. | |
| 7,756,430 | B1 | 7/2010 | Seongsik | |
| 8,105,672 | B2 | 1/2012 | Nakamura et al. | |
| 9,423,717 | B2 * | 8/2016 | Chang | G03G 15/0233 |
| 2002/0051654 | A1 | 5/2002 | Nimi et al. | |
| 2004/0213600 | A1 | 10/2004 | Kazuhiko | |
| 2007/0033984 | A1 | 2/2007 | Goop | |
| 2010/0080631 | A1 | 4/2010 | Ogiyama et al. | |
| 2010/0183334 | A1 | 7/2010 | Fukunaga et al. | |
| 2011/0129258 | A1 | 6/2011 | Shin et al. | |
| 2012/0033984 | A1 | 2/2012 | Yuichi | |

FOREIGN PATENT DOCUMENTS

| | | | |
|---|---|---|---|
| EP | 1209542 | 5/2002 | |
| EP | 1542087 | 6/2005 | |
| EP | 1841301 | 10/2007 | |
| GB | 2282672 | 4/1995 | |
| JP | 02127337 A * | 5/1990 | |
| JP | 9054479 | 2/1997 | |
| JP | 2000029320 | 1/2000 | |
| JP | 3033028 | 4/2000 | |
| JP | 2005352158 | 12/2005 | |
| JP | 2007093981 | 4/2007 | |
| JP | 2007187814 | 7/2007 | |
| JP | 2008026380 | 2/2008 | |
| JP | 2010048881 | 3/2010 | |
| JP | 2010054891 | 3/2010 | |
| JP | 2010107796 | 5/2010 | |
| KR | 20080083901 | 9/2008 | |
| WO | 2007064975 | 6/2007 | |
| WO | 2012105987 | 8/2012 | |
| WO | WO 2013130083 A1 * | 9/2013 | G03G 15/0233 |

OTHER PUBLICATIONS

International Search Report and Written Opinion of the International Searching Authority, dated Jan. 2, 2013, issued in related PCT Application No. PCT/US2012/035840.

D'Antonio, Characteristics of In-air Thermoplastic Recording, Applied Optics, vol. 8, Issue S1, 1969, pp. 142-148, abstract only.

Fridman et al., Non-thermal atmospheric pressure discharges, Institute of Physics Publication, 2005, pp. R1-R24.

Kadonaga et al., A Study of Non-Uniform charging by Charging Roller with DC Voltage, Journal of Imaging Science and Technology, vol. 43, No. 3, May/Jun. 1999, 6 pp.

Kogelschatz, Filamentary and Diffuse Barrier Discharges, accessed at http://etds.lib.ncku.edu.tw, printed from website Oct. 2012.

* cited by examiner

CHARGE ROLLER FOR ELECTROGRAPHIC PRINTER

CROSS-REFERENCE

This Application is a Continuation of U.S. patent application Ser. No. 14/437,295, filed Apr. 21, 2015, entitled "CHARGE ROLLER FOR ELECTROGRAPHIC PRINTER", which claims benefit to PCT/US2012/060224, filed Oct. 15, 2012, entitled "CHARGE ROLLER FOR ELECTROGRAPHIC PRINTER", both of which are incorporated herein by reference.

BACKGROUND

Liquid electrophotography has revolutionized high speed and high volume printing. Via liquid electrophotography, digital printers or presses perform print jobs without films or the plates that are typically associated with traditional offset lithography. Accordingly, among other features, a press operator can change the content while the digital press is still completing other jobs, allowing digital printing services to be more nimble and flexible than printing services employing traditional offset lithography.

DETAILED DESCRIPTION

Figure 1:
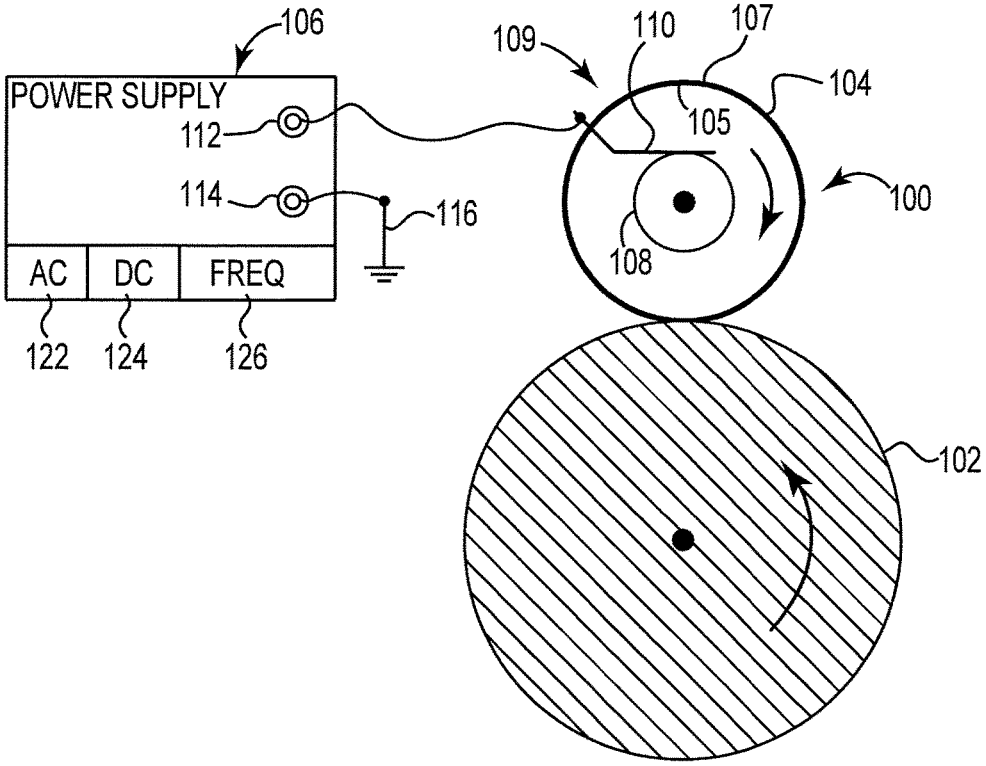
FIG. 1 is a side view schematically illustrating a print system including a charge roller with a resistive coating, according to one example of the present disclosure.

In the following detailed description, reference is made to the accompanying drawings which form a part hereof, and in which is shown by way of illustration specific examples of the present disclosure, which may be practiced. In this regard, directional terminology, such as "top," "bottom," "front," "back," "leading," "trailing," etc., is used with reference to the orientation of the Figure(s) being described. Because components of examples can be positioned in a number of different orientations, the directional terminology is used for purposes of illustration and is in no way limiting. Parameters such as voltages, temperatures, dimensions, and component values depend on the exact printing system implementation and are approximate for some typical Indigo printing systems. In one aspect, "Ground" refers to a common return, not necessarily to any earth ground. It is to be understood that other examples may be utilized and structural or logical changes may be made without departing from the scope of the present disclosure. The following detailed description, therefore, is not to be taken in a limiting sense.

At least some examples of the present disclosure provide for increased longevity in the lifetime of a charge roller in a printing system, such as but not limited to, a liquid electrophotography printing system. In one example, a charge roller includes a metal external surface and a resistive coating overlies the metal external surface. In one aspect, the charge roller is positionable in charge-transferring relation to an imaging surface.

In particular, at least some examples of the present disclosure overcome longevity issues typically associated with some traditional charge rollers (used in high-speed digital printing systems), which have a limited lifetime because their conductively-loaded, outer rubber portion deteriorates with use. Deterioration can occur due to changes in electrical or mechanical properties of the outer rubber portion. For example, depletion of ionic conductive agents can after the electrical resistivity of the outer rubber portion while hydrolysis or other chemical reactions can compromise the mechanical integrity of the outer rubber portion. Although a lifetime of a traditional charge roller may be measured in hundreds of thousands of printed sheets of paper, many digital presses have such high throughput that a traditional charging roller often is replaced every several days. The frequent replacement of charging rollers can add to the total cost of operating the printing system and increase the cost per printed page.

Fortunately, at least some examples of the present disclosure provide charge rollers with significantly enhanced longevity, thereby reducing or eliminating replacement of charging elements in high-speed digital printers without compromising print quality.

Among other features, the longevity of charge rollers in at least some examples of the present disclosure is achieved, at least in part, because the resistive coating is made from materials that are chemically stable in the environment of the printing system. In one example, the resistive coating is an inorganic, non-polymeric film of an alloy of alumina (Al.sub.2O.sub.3) and titania (TiO.sub.2). This metal oxide is generally immune from chemical change by exposure to environmental chemistries, even in the presence of an atmospheric plasma. Accordingly, this aspect facilitates that a mechanical or chemical integrity of the example materials generally is not compromised during extended use in a printing application, such as when acting as an outer resistive coating of a charge roller.

Moreover, the longevity of charge rollers in at least some examples of the present disclosure, at least in part, arises from electrical stability of the inorganic material forming the outer resistive coating. In particular, conductivity is generally inherent to the inorganic material forming the outer resistive layer, and therefore is not readily lost. In contrast, the desired conductivity of the outer rubber portion of a traditional charge roller used for high-speed digital electrophotographic presses is artificially produced via mixing-in foreign material (conductive agents) with the elastomeric rubber material. Over time, these conductive agents each out from the rubber material, thereby sometimes causing resistivity of the outer rubber portion to increase, which in turn, causes an increased voltage drop across the outer rubber portion of the traditional charge roller. As a result, less charging occurs on the photoconductive imaging surface, leading to lesser performance of the photoconductive imaging surface. However, due to the inherent conductivity of the inorganic material forming the outer resistive coating in examples of the present disclosure, the outer resistive coating remains generally electrically stable over time.

While some types of conductive additives (e.g. carbon black) are not as likely to leach from the outer rubber portion of a traditional charge roller, these additives typically provide less charging uniformity than is desired.

Additionally, the longevity of charge rollers in at least some examples of the present disclosure is achieved, at least in part, because the resistive coating is made from materials that are electrically stable in the environment of the printing system. In some examples, the resistive coating is an inorganic, non-polymeric material with an electrical conductivity derived from electronic states in the material that are not altered by exposure to electric field, electric current, environmental chemistries, or atmospheric plasma. Accordingly, this aspect facilitates that the electrical resistivity and dielectric constant of inorganic, non polymeric materials, identified in at least some examples of this disclosure for use as the resistive coating, generally do not change during extended use in a printing application, such as when acting as an outer resistive coating of a charge roller.

Furthermore, the longevity of charge rollers in at least some examples of the present disclosure is achieved, at least in part, because the metal external surface of the body of the charge roller is made of materials with sufficient hardness to resist denting, nicks, and/or other surface abrasions. In some examples, the material comprises stainless steel or aluminum. In one example, a hardness of the resistive coating is at least as great as a hardness of stainless steel.

Moreover, in some instances, the outer resistive coating has a hardness that is significantly greater than the hardness of the metal external surface of the body of the charge roller. In one example, the hardness of the outer resistive coating is more than an order of magnitude greater than the hardness of the metal external surface, such as stainless steel.

Accordingly, in addition to the chemical and mechanical stability of the resistive coating, the hardness of the metal external surface of the body of the charge roller and the hardness of the outer resistive coating work together to ensure relative "permanency" of the charge roller when deployed in a printing system.

Moreover, in at least some examples, the outer resistive coating of the charge roller has a thickness sufficient to, and is composed in a manner to, substantially suppress an intensity (e.g. amplitude and/or quantity) of filamentary streamers, which are generated in an air gap between the charge roller and a dielectric layer of the imaging surface. In one aspect, the filamentary streamer discharges occur when a charging voltage sufficient to cause air breakdown is applied between the charge roller and ground plane associated with the imaging surface (during operation of the printing system for printing). In the absence of a protective resistive coating on the metal external surface of the charge roller, non-uniform charge distribution emanating from filamentary streamer discharges might otherwise lead to unacceptable alligator patterns in the printed output. In addition, a high amplitude of filamentary streamer discharges can degrade the performance of the photoconductive imaging surface.

In one example, the resistive coating causes a substantial reduction in an amplitude of the filamentary streamer discharges. For example, the presence of the resistive coating (on the metal external surface of the charge roller) can reduce the amplitude of filamentary streamer discharges by 2-10 times the amplitude of filamentary streamer discharges that would otherwise occur in the absence of a resistive coating. In further examples, the presence of the resistive coating can reduce the streamer amplitudes by more than 10 times, such as a 25 times reduction in the streamer amplitude. Further examples are described below.

In at least some examples, adding the resistive coating to the metal external surface of the charge roller also causes a substantial reduction in total integrated charges caused by filamentary streamer discharges. In other examples, the resistive coating causes a substantial reduction in both the amplitude and quantity of filamentary streamers that would otherwise occur in the absence of the resistive coating.

In some examples, the resistive coating has a resistivity factor falling within a range of 10.sup.3<.rho..di-elect cons..sub.r<10.sup.9 Ohm-cm, wherein .rho. represents a resistivity of the coating material and .di-elect cons..sub.r represents a dielectric constant (or relative electric permittivity) of the material forming the resistive coating. In other examples, the resistive coating has a resistivity factor falling within a range of 10.sup.4<.rho..di-elect cons..sub.r<10.sup.8 Ohm-cm. In one example, the resistive coating has a thickness according to the relationship in which t/.di-elect cons. is at least about 40 micrometers. In other examples, the resistive coating has a thickness according the relationship in which t/.di-elect cons..sub.r is at least about 5 micrometers.

In one example, a charge roller having a metal external surface and an outer resistive layer (or coating) forms part of a liquid electrophotography-based printing system, such as but not limited to, the Indigo printing system by Hewlett-Packard Company. In one example, electrophotographic printing encompasses a print system in which a discharge source (e.g., a laser beam scanner) scans a charged imaging surface (e.g., a photoconductor) to form an electrostatic latent image on the imaging surface. A liquid ink developer of a selected color is applied to the electrostatic latent image to develop the electrostatic latent image, and the developed image is printed on a print medium via a transfer unit, such as an intermediate transfer drum and an impression drum. At least some of the examples of a resistively coated, metal charge roller, as described and illustrated below, are provided with respect to liquid electrophotographic printers. However, it will be understood that the examples of resistively-coated, metal charge rollers in the present disclosure are not strictly limited to use in liquid electrophotographic printers. It will be understood that at least some of the examples herein may be applied to other type of electrophotographic printers such as, but not limited to, dry toner electrophotographic printers.

[0035] In one example, the inorganic, non-polymeric resistive coating solely defines the outer layer of the charge roller and is in direct contact with a metal external surface of a body of the charge roller underlying the resistive coating. In other examples, the resistive coating does not solely define the outer layer of the charge roller.

In one example, the resistive coating defining the outer layer of the charge roller is made solely of the inorganic, non-polymeric material. In other examples, the resistive coating defining the outer layer of the charge roller is not made solely of the inorganic, non-polymeric material. These examples, and additional examples, are described in association with FIGS. 1-17.

FIG. 1 is a diagram schematically illustrating a print system 100, according to one example of the present disclosure. As shown in FIG. 1, printing system 100 includes an imaging surface 102, a charge roller 104, and a power supply 106. The charge roller 104 includes a metal external surface 105 and a resistive layer 107 overlying the metal external surface 105, the details of which are further shown in at least FIGS. 2-3. In general terms, the charging roller 104 is in charge-transferring relation with the imaging surface 102 in order to deposit an electric charge on the imaging surface 102 during operation of the printing system for printing.

It will be understood that the elements shown in FIG. 1 are depicted for illustrative purposes and are not necessarily to scale. For example, in at least some instances the charge roller 104 typically would be much smaller (than shown in FIG. 1) in proportion relative to the drum providing imaging surface 102.

In some examples, the power supply 106 generates a voltage potential at the metal external surface 105 of the charge roller 104. The metal external surface 105 of the charge roller 104 is disposed to deposit an electric charge on, the imaging surface 102. While FIG. 1 depicts charge roller 104 in rolling contact with the imaging surface 102, it will be understood that in some examples, the printing system employs a fixed air gap between the charge roller 104 and the imaging surface 102, such as the example later described in association with FIG. 5. In at least some examples, no compositions or other conductive agents come between the resistive layer 107 (of the charge roller 104) and the imaging surface 102. By using a charging element having a metal external surface, the charge roller is expected to last for the lifetime of the printing system with little or no degradation. At the very least, it is expected that the charging roller with the metal external surface (and overlaid resistive coating) will exhibit much less degradation than traditional charging element having an organic polymer surface (such as conductively loaded rubber).

With this in mind, the charge roller in at least some examples of the present disclosure is sometimes referred to in this description as being "permanent." However, in at least some examples, the charge roller is releasably mounted in the printing system to facilitate replacement if desired.

In some examples, the printing system 100 further comprises a coupling mechanism 109. As shown in FIG. 1, in one example the coupling mechanism 109 includes a slip contact 108 (incorporated in charge roller 104, e.g. electrical brush) that is in electrical communication with a contact arm 110, which in turn, is connected to a first power output terminal 112 of the power supply 106. A second power output terminal 114 of the power supply 106 is connected to a common return 116 and through the return to the imaging surface 102. In other examples, other connection techniques are used (instead of coupling mechanism 109) to couple electric power from the power supply 106 across the charge roller 104 and the imaging surface 102.

In one example, power supply 106 charges the charge roller 104 (and thereby charges imaging surface 102) via an AC component 122, a DC component 124, or a combination of both. Power supply 106 also includes a frequency selector 126.

Figure 2:
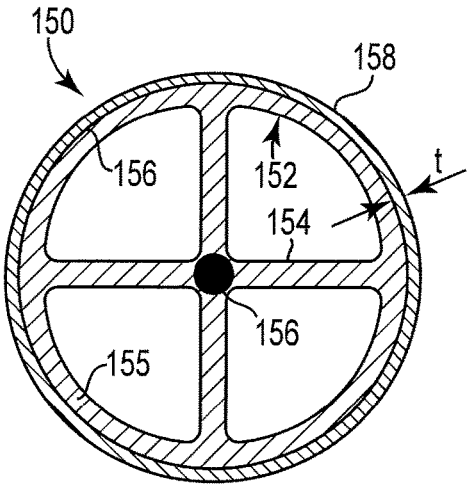
FIG. 2 is a side sectional view schematically illustrating a hollow charge roller including a resistive coating, according to one example of the present disclosure.

FIG. 2 is a sectional view of a charge roller 150, according to an example of the present disclosure. As shown in FIG. 2, charge roller 150 includes a hollow cylindrical frame 152 (appearing circular in the cross-section of FIG. 2) including an outer ring 155 supported by radial struts 154, with frame 152 being rotatably mounted on axle 156. Frame 152 also includes an external surface 156. In one example, the entire frame 152 (including external surface 156) is made of a metal material, such as but not limited to, stainless steel or aluminum. In other examples, portions of frame 152, particularly including external surface 156, are made of a metal material such as stainless steel or aluminum. In one example, the hollow cylindrical frame 152 is supported by end caps without the use of radial struts 154.

In addition, as further shown in FIG. 2, charge roller 150 includes an outer resistive layer 158 overlaid directly on top of, and in contact with, the metal external surface 156 of charge roller 150. In general terms, the outer resistive layer 158 includes an inorganic, non-polymeric material. In at least some examples, the inorganic, non-polymeric material is a coating of a hard semiconductor-based material, such as silicon carbide (SiC) while in other examples, the inorganic, non-polymeric material is a coating of an insulator material with electrically active defect states, such as a mixture of aluminum oxide (Al.sub.20.sub.3) and titanium oxide (TiO-.sub.2).

In at least one example, the resistive coating 158 is at least as hard as the metal external surface (e.g. stainless steel), thereby ensuring the integrity and smoothness of the outer surface charge roller 150 over a lifetime of use. In some examples, the resistive coating 158 is substantially harder than the metal external surface (e.g. stainless steel) of the charge roller, further enhancing the longevity of the charge roller. In another aspect, a longevity of the charge roller in at least some examples is achieved, at least in part via the previously described chemical and mechanical stability of the resistive coating.

Further details regarding these materials, and other suitable resistive coatings, are described below.

In addition, the resistive coating 158 has a thickness (t) and a dielectric constant (.di-elect cons..sub.r), the specifics of which are described later in association with at least FIGS. 7-9.

In one example, at least the metal external surface 156 of the charge roller 150 comprises stainless steel (e.g. stainless steel 304). In one aspect, the stainless steel material exhibits a hardness according to the Mohs scale of about 4.5 and according to the Knoop scale, exhibits a hardness (kg/mm/mm) of about 138. In another example, at least the metal external surface of the charge roller comprises aluminum (e.g. aluminum 6061). In one aspect, the aluminum material exhibits a hardness according to the Mohs scale of about 3.5 to about 4 and according to the Knoop scale, exhibits a hardness (kg/mm/mm) of about 100.

In some examples, the resistive coating includes an inorganic, non-polymeric material such as a semiconductor material. In one example, the semiconductor material is chosen from silicon (Si), hydrogenated silicon (Si:H), or silicon carbide (SiC). In one aspect, the silicon carbide material (SiC) exhibits a hardness according to the Mohs scale of about 9 to 9.5 and according to the Knoop scale, exhibits a hardness (kg/mm/mm) of about 2960. Therefore, in some examples, the hardness of the resistive coating according to at least one scale (e.g. Knoop) is at least one order of magnitude greater than the hardness of the metal external surface.

In other examples, the resistive coating includes an inorganic, non-polymeric material such as an insulator with electrically active defect states. In one example, the insulator with electrically active defect states is chosen from chromium oxide (Cr.sub.20.sub.3), aluminum oxide (Al.sub.20.sub.3), aluminum oxide:zinc oxide mixture (Al2O3:ZnO), aluminum oxide:tin oxide mixture (Al2O3:SnO), or aluminum oxide:titanium oxide mixture (Al.sub.20.sub.3:TiO.sub.2). In the foregoing metal oxide materials, in at least one example, electrically active defect states may be introduced by using compositions that are slightly deficient in oxygen compared to the stoichiometric oxygen composition.

In one aspect, the aluminum oxide material (A.sub.20.sub.3) exhibits a hardness according to the Mohs scale of about 9 and according to the Knoop scale, exhibits a hardness (kg/mm/mm) of about 2000. In one aspect, the chromium oxide material (Cr.sub.20.sub.3) exhibits a hardness according to the Mohs scale of about 8 to about 8.5 and according to the Knoop scale, exhibits a hardness (kg/mm/mm) of about 2955. In one aspect, the titanium oxide material (TiO.sub.2) exhibits a hardness according to the Mohs scale of about 6 and according to the Knoop scale, exhibits a hardness (kg/mm/mm) of about 700.

Therefore, in some examples, the hardness of the resistive coating according to at least one scale (e.g. Knoop) is at least one order of magnitude greater than the hardness of the metal external surface.

Further aspects regarding the resistivity, and the streamer-suppressing effects, of these resistive coatings are further described later in association with at least FIGS. 7-16.

Figure 3:
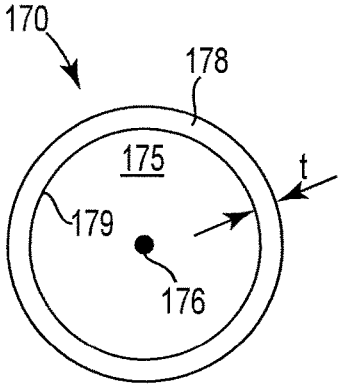
FIG. 3 is a side sectional view schematically illustrating a solid charge roller including a resistive coating, according to one example of the present disclosure.

FIG. 3 is a sectional view of a charge roller 170, according to an example of the present disclosure. As shown in FIG. 3, charge roller 170 comprises substantially the same features and attributes as charge roller 150, as previously described in association with FIG. 2 except with roller 170 defining a solid cylindrical body 175 rotatably mounted on axle 176.

As further shown in FIG. 3, resistive coating 178 defines an outermost layer of charge roller 170, and is in direct contact against the metal external surface 179 of the body 175 of the charge roller. It also will be understood that the thickness of the resistive layer 178 (and 158 is FIG. 2) relative to the diameter of body 175 (and drum 152 in FIG. 2) is somewhat exaggerated and not to scale in FIGS. 2-3 for illustrative clarity.

Figure 4:
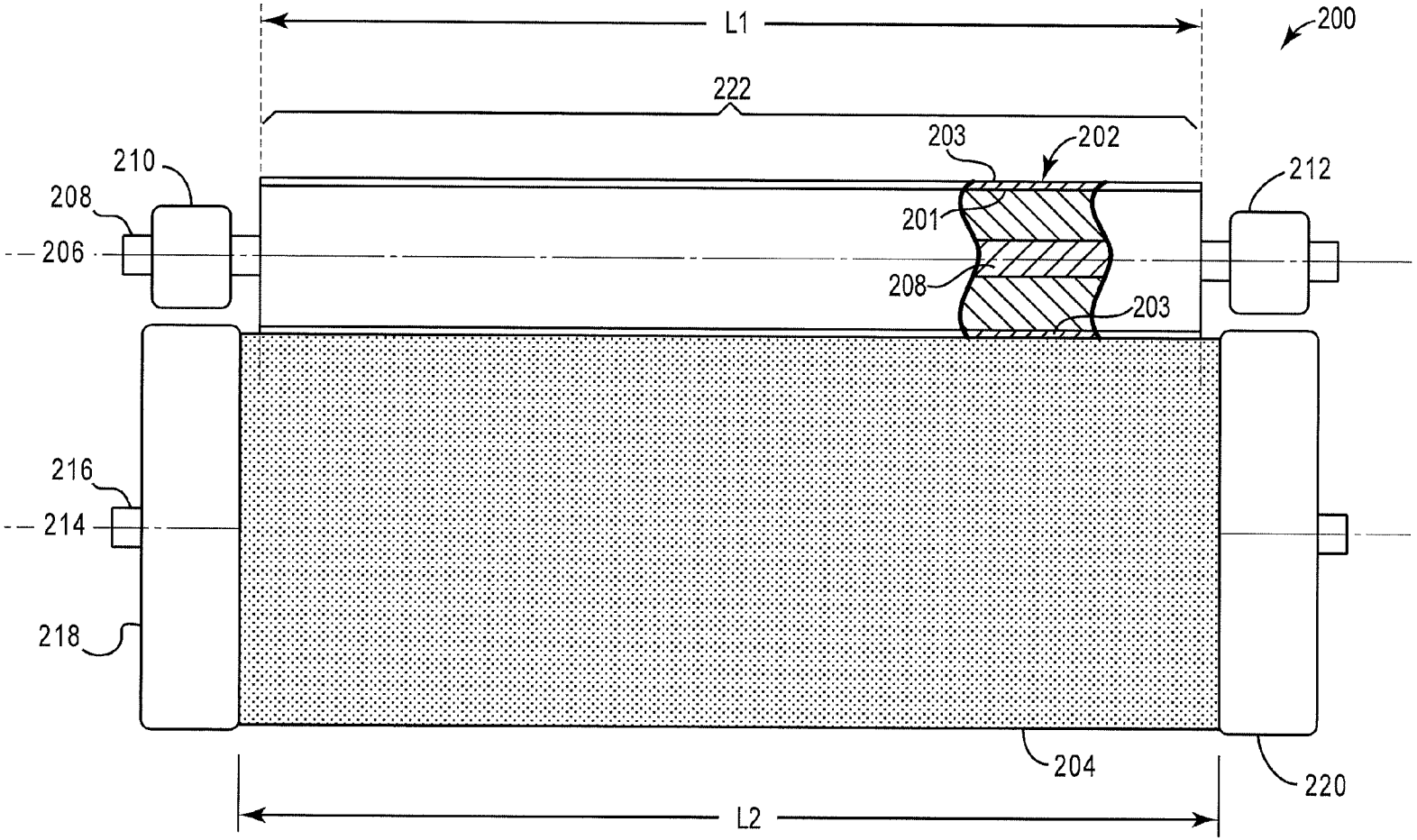
FIG. 4 is a front view schematically illustrating a charge roller in rolling contact and charge-transferring relation to an imaging drum, according to one example of the present disclosure.

FIG. 4 is a side view of a printing system 200 having a charge roller 202 rotationally coupled to, and in rolling contact with, an imaging surface 204, according to one example of the present disclosure. As shown in FIG. 4. As discussed below, in one example the imaging surface 204 comprises a drum covered with a photoconducting sheet. Meanwhile, as shown in the partial sectional view in FIG. 4, the charge roller 202 includes a roller or drum having a metal external surface 201 and an outer resistive layer 203. It also will be understood that the thickness of the outer resistive layer 203 relative to the diameter of the imaging surface is exaggerated and not to scale for illustrative clarity.

As further shown in FIG. 4, the outer resistive layer 203 of charge roller 202 is in direct physical contact with the imaging surface 204. In one aspect, the charge roller 202 rotates about an axis 206 by means of a shaft 208 and is driven by the rotation of the imaging surface 204.

In one example, printing system 200 includes a first drive wheel 210 placed on one end of the shaft 208 and a second drive wheel 212 placed on the other end of the shaft 208. In one instance, this arrangement is deployed in an implementation, such as in an Indigo digital press, in which the imaging surface 204 comprises a photoconducting sheet with a discontinuous seam region (not shown) resulting from overlap of two ends of the sheet. Such a seam region may be slightly depressed relative to other portions of the imaging surface. Accordingly, the printing system 200 is adapted to accommodate the seam region.

With this in mind and as further shown in FIG. 4, the imaging surface 204 rotates about an axis 214 by means of a shaft 216. Disks 218 and 220 are attached to opposite ends of the imaging surface 204. The drive wheel 210 is generally limited to contacting the disk 218 when the charge roller 202 is within the seam region, thereby preventing direct contact between the charge roller 202 and the seam region, thereby avoiding undesired impact between the charge roller 202 and the seam region. Similarly, the drive wheel 212 is generally limited to contacting the disk 220 when the charge roller 202 is within the seam region.

In some examples, printing system 200 includes a motor (not shown) that drives the shaft 216, for example through a gear (not shown) attached to the shaft 216. In this way, sufficient torque is provided to rotate the imaging surface 204 and rotate the charge roller 202.

In another aspect, the charge roller 202 has a length (L1) that is slightly shorter than a length (L2) of the imaging surface 204 such that the charge roller 202 defines an image area 222 across the imaging surface 204 sized to avoid creating a short between the charge roller 202 and a ground associated with the imaging surface 204.

Figure 5:
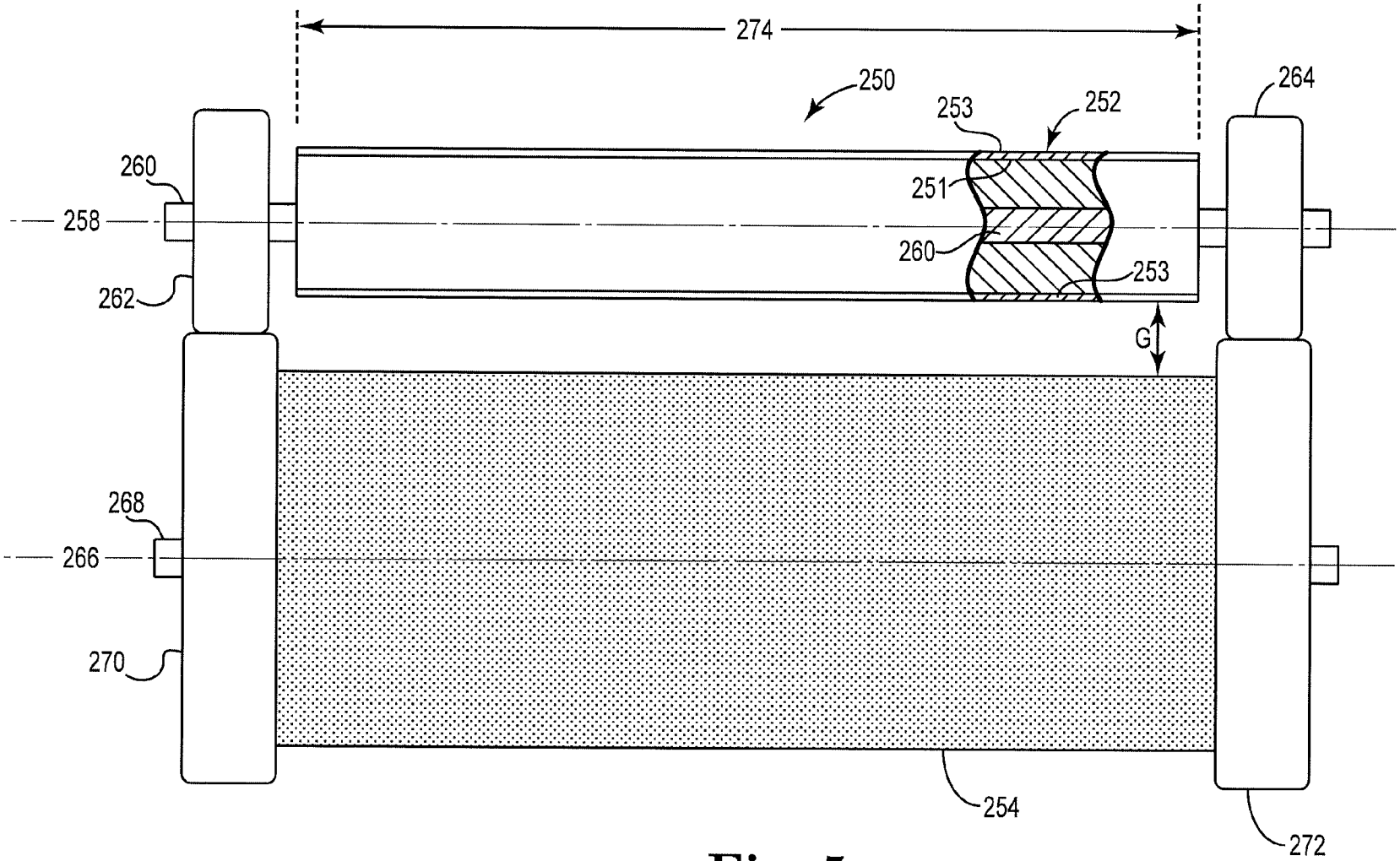
FIG. 5 is a front view schematically illustrating a charge roller in charge-transferring relation to an imaging drum while maintaining a controlled gap between the charge roller and the imaging drum, according to one example of the present disclosure.

FIG. 5 is a side view of a printing system 250 having a charge roller 252 rotationally coupled to, but spaced apart from, an imaging surface 254 of a photoconductor, according to one example of the present disclosure. In general terms, printing system 250 includes substantially the same features and attributes as printing system 200 (described in association with FIG. 4), except that charge roller 252 is spaced apart from the imaging surface 254 by a fixed air gap (G). In one example, the gap (G) is any distance up to about 20 micrometers or even larger if adequate, uniform charge transfer can be achieved from the charge roller 252 to the imaging surface 254.

As further shown in FIG. 5, the charge roller 252 rotates about an axis 258 by means of a shaft 260 coupled to a drive wheel 262 on one end and a drive wheel 264 on the other end. Meanwhile, the imaging surface 254 rotates about an axis 266 by means of a shaft 268 with an imaging surface disk 270 on one end and an imaging surface disk 272 on the other end. With this arrangement, the charge-roller drive wheel 262 engages the imaging surface disk 270, and the charge-roller drive wheel 264 engages the imaging surface disk 272. In a manner similar to the previous example shown in FIG. 4, in some instances there may be more or fewer drive wheels and disks, and rotational torque to the imaging surface may be provided by a motor (not shown) through a gear (not shown) attached to the shaft 268. Finally, the charge roller 252 defines an image area 274 relative to the imaging surface 254.

Figure 6:
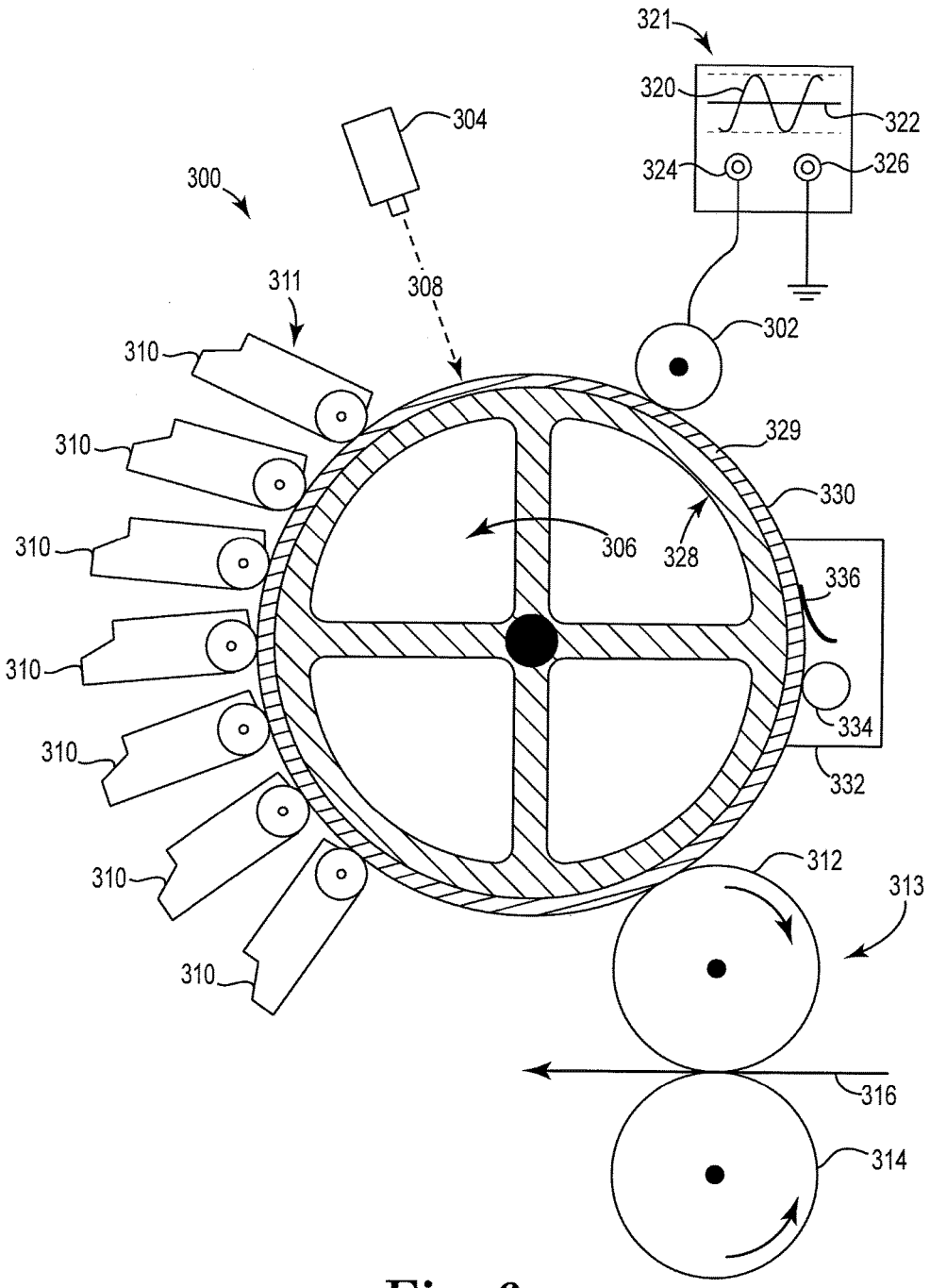
FIG. 6 is a side view schematically illustrating a liquid electrophotography printing system including a charge roller with a resistive coating, according to one example of the present disclosure.

FIG. 6 is a side view schematically illustrating a printing system 300 having a charge roller 302 in charge-transferring relation with an imaging surface 330, according to one example of the present disclosure. In one example, charge roller 302 includes at least substantially the same features and attributes as one of charge rollers 150 or 170 in association with FIG. 2 or 3, respectively, and as one of charge roller 202 or 252 in association with FIG. 4 or 5, respectively. Accordingly, charge roller 302 includes an outer resistive layer in the manner previously described and illustrated. In one example, printing system 300 includes a liquid electrophotography printing system.

As shown in FIG. 6, printing system 300 includes a charge roller 302, a discharge source 304, a developer array 311, a transfer unit 313, a cleaner 332, and a power supply 321. In one aspect, charge roller 302 is in charge-transferring relation to imaging surface 330 to produce a substantially uniform charge on imaging surface 330.

In one aspect, the discharge source 304 is aimed at the imaging surface 330 as indicated by an arrow 308. At least one ink developer roller 310 of array 311 is disposed in ink-dispensing relation with the imaging surface 330. While FIG. 6 depicts one example including seven ink dispenser rollers 310 in an array 311, in other examples fewer or more ink dispenser rollers 310 may be used.

The transfer unit 313 is generally in ink-transferring relation with the imaging surface 330 and defines a media movement path 316.

In some examples, the transfer unit 313 comprises an intermediate transfer drum 312 and an impression drum 314. The transfer drum 312 is rotationally coupled to and in direct contact with the imaging surface 330 while the impression drum 314 is rotationally coupled to the intermediate transfer drum 312. The paper movement path 316 is defined between the intermediate transfer drum 312 and the impression drum 314.

In one example, the imaging surface 330 comprises a photoconductive sheet 329 carried by a drum 328. In some instances, the photoconductive sheet 329 is referred to as an organic photoconductor (OPC) because of the organic material forming the photoconductive sheet 329. In other instances, the photoconductive sheet 329 is referred to as a photo imaging plate (PIP). As discussed previously, fabric or other material (not shown) may be disposed between the drum 328 and the photoconductive sheet 329. In other examples the imaging surface 330 may comprise a dielectric drum or a photoconductor drum.

In one example, the discharge source 304 comprises a laser. In operation, when a beam of light from the laser reaches points on the electrostatically-charged imaging surface 330, the light discharges the surface at those points. A charge image is formed on the imaging surface 330 by scanning the beam of light across the imaging surface 330. In other examples, other types of image-forming energy sources or addressable discharging systems are used, such as an ion head or other gated atmospheric charge source. The particular type of image-forming energy source used in printing system 300 depends on what kind of imaging surface is being used.

In one example, printing system 300 includes cleaner 332 as noted above. For instance, cleaner 332 includes a roller element 334 and a scraping or brushing element 336, or other devices to remove any excess ink remaining on the imaging surface 330 after transferring imaged ink to the transfer roller 312. In some examples, roller element 334 includes a single roller while in other examples, roller element 334 includes at least two rollers, such as one wetting roller and one sponge roller.

In one example, the power supply 321 provides electric power with an AC component 320 and a DC component 322. The power supply is connected to the charge roller 302 through a first terminal 324 in electrical communication with the charge roller 302 and a second terminal 326 in electrical communication with ground.

In some examples, a voltage potential between the charge roller 302 and the ground plane (of the photoconductor) is a combination of a DC voltage and an AC voltage. In other examples, the voltage between the charge roller 302 and the ground plane is a DC voltage.

As noted above, by providing a charge roller 302 with a hard metal external surface (such as stainless steel or aluminum) and a hard resistive coating, greater longevity is achieved such that the charge roller may even become a permanent element within a printing system. The hard metal external surface in conjunction with a hard resistive coating prevents nicks and scratches that may otherwise occur during handling. In addition, the hard resistive coating materials (e.g., semiconductors and metal oxides) are not subject to electrical and chemical degradation typically associated with traditional charge rollers having conductively-loaded, rubber-based exterior portions.

Because a bare metal external surface of a charge roller would ordinarily be expected to produce filamentary streamers, by providing a resistive coating (according to some examples of the present disclosure) on top of the metal external surface of the body of the charge roller 302, a magnitude (e.g. amplitude) of the streamer discharges is suppressed to a sufficient degree to achieve desired printer operation. Stated differently, while the addition of the resistive coating to the metal external surface of the body of the charge roller 302 does not completely eliminate the formation and discharge of filamentary streamers, the presence of the resistive coating on the metal external surface of the charge roller 302 produces a substantially uniform charge distribution on the imaging surface 330, while simultaneously achieving a target charge (e.g. 1000 volts, in one example) at the imaging surface 330.

Prior to presenting specific examples of resistive coatings for metal charge rollers, this description provides a background addressing at least one physics model by which at least some examples of the present disclosure aim to suppress the formation and discharge of filamentary streamers.

A streamer is one type of electrical air discharge (or electrical conduction) that occurs in a strong electric field between two spaced apart electrodes. In one aspect, the streamer is more formally known as a filamentary streamer because of its generally cylindrical or filamentary shape that extends between (i.e. bridges the gap) the two electrodes. In one example, such filamentary streamers have a diameter of about 100 microns and have durations on the order of 100 nanoseconds, so the streamers are discharged almost abruptly as they are formed (in the case of dielectric barrier discharge where either one or both of the electrode is covered with a insulating dielectric). Accordingly, at least in the context of the present disclosure, the filamentary streamers are sometimes referred to as filamentary streamer discharges. In one aspect, the filamentary discharge exhibits a high gain and occurs in a higher pressure environment such as in the typical atmospheric condition.

In one aspect, a filamentary streamer is formed via a gas ionization process, in which free electrons subject to strong acceleration in the electric field (created between the two spaced apart electrodes) impact other atoms, causing a release of other electrons, which are accelerated and in turn impact further atoms, which frees yet other electrons. This cascading or chain reaction behavior resembles an avalanche of electron flow resulting in a breakdown in the gaseous dielectric medium (e.g. air) such that a path of electrical conduction is established through the air between the two spaced apart electrodes. This behavior is commonly referred to as an electron avalanche process. In another aspect, the electron avalanche process is also known as a Townsend discharge and is characterized, as least in one sense, by a Townsend impact ionization coefficient generally represented by the alpha symbol (.alpha.) represented in FIG. 7.

In general terms, a Paschen curve represents the minimum breakdown voltage as a function of electrode spacing (d), operating pressure and gas composition. In some instances the electrode spacing (d) is also referred to as the distance of avalanche propagation. With this in mind, according to one example, a filamentary streamer discharge occurs when .alpha.>20 in the avalanche process, where .alpha. is the Townsend coefficient and where the electron number increases exponentially as N=N.sub.0exp(alpha.d), where N is the final number of electrons, and N.sub.0 is the initial number of electrons.

In one example, an electron density of a filamentary streamer discharge is in the range of 10.sup.14-10.sup.15 cm.sup.3 and the number of charges within a streamer is 10.sup.9-10.sup.10.

The electrical and dimensional parameters of resistive coatings of a charge roller, according to at least some examples of the present disclosure, are determined based on the foregoing example model of filamentary streamer discharges.

In one example, an electrical resistivity and a thickness of a resistive coating (overlaying the metal external surface of a charge roller) provided to suppress filamentary streamer discharge is expressed via the relationship.

10.sup.4<.rho..di-elect cons..sub.r<10.sup.8 (.OMEGA.cm),V.di-elect cons..sub.r>38 .mu.m, (1)

where .rho. is electrical resistivity, t is the thickness of the resistive coating film, and .di-elect cons..sub.r is the relative electrical permittivity (i.e. dielectric constant).

According to at least one example model, derivations of these conditions are described in the following paragraphs. In doing so, reference periodically will be made to FIGS. 8-9. FIG. 8 is a side view schematically illustrating a charge roller in close proximity to imaging surface 410 (e.g. photoconductive imaging plate—PIP), according to one example of the present disclosure. As shown in FIG. 8, charge roller 400 includes body 402 with an outer resistive coating 406 having thickness (t) and the resistive coating 406 directly overlies the metal external surface 404 of body 402 of charge roller 400 and in which charge roller 400 is in rolling contact with an imaging surface 410 at nip 420. FIG. 9 is substantially similar to FIG. 8, except further schematically representing dimensional aspects associated with preventing streamer formation, as described below.

First, a lower end of the resistivity factor according to equation 1 for a resistive coating will be derived below.

At the Paschen threshold, and therefore during glow discharge, .alpha.d.apprxeq.2 to 5, depending upon the cathode material, such as the resistive coating on the metal external surface of the charge roller. In contrast, a threshold at which filamentary streamers occur is .alpha.(E)d=20, and is achieved when an extra electric field generated by extra surface charges is induced in response to air discharges.

However, in accordance with the general principles in at least some examples of the present disclosure, by limiting the induced surface charges, the relationship .alpha.d can be maintained below the expected filamentary streamer threshold value of 20. With this in mind, the number of surface induced charges can be calculated with the knowledge of free charge carrier densities (n) and carrier mobility (.mu.). Within an example streamer size (D.sub.str=100 micrometer) and its duration (t.sub.str=100 nanoseconds), the induced charge (N.sub.ind) within the streamer area during streamer duration is given by the relationship, N.sub.ind=n(.mu.E.sub.coet)(t.sub.str)(.pi.D.sub-.str.sup.2/4)=n(.mu.E.su-b.air/.di-elect cons-..sub.r)(t.sub.str)(.pi.D.sub.str.sup.2/4) (2)

From the condition N.sub.ind<N.sub.str, the target electrical conductivity is

.sigma.=nq. mu.<(4/.pi.)qN.sub.str/[(E.sub.air/.di-elect cons..sub.r)t.sub.strD.sub.str.sup.2]=1.times.10.sup.-4.di-elect cons..sub.r .OMEGA/cm, or .rho..di-elect cons..sub.r>10.sup.4 .OMEGA.cm, for E.sub.air=15V/.mu. (3)

Accordingly, in one example according to the foregoing physics model, a lower end of the range of the resistivity dielectric constant product (.rho. .di-elect cons..sub.r) for the resistive coating is 10.sup.4 .OMEGA.cm. While resistivity p represents the induced number of charges within the coating material in response to filamentary streamer discharges, the dielectric constant .di-elect cons..sub.r is represented in equation (3) because the electric field within the outer resistive coating is inversely proportional to the dielectric constant, where the electric field determines a speed of charge carrier induction.

In one aspect, the upper bound of the resistivity depends on the voltage drop that can be tolerated across the resistive coating of the charge roller while still achieving satisfactory charging of the imaging surface. This upper boundary also depends, at least in part, on the speed of the printer. In one example, in which the example charge roller is employed in a liquid electrophotography printing system, the printer speed is 2 meters/second. Accordingly, the upper bound of resistivity for the resistive coating comes from the condition for the charge dissipation time during charging in the digital press. In one example digital press, the charging rate is 1V/.mu.sec, and, if a 10 Volt drop is allowed across the resistive coating 406 of the charge roller 400 as represented in FIG. 8, a target dissipation time for the charge is about 10 microseconds. In one example model, the charge dissipation time is given from a "leaky capacitor model" by the relationship, .tau.=.rho..di-elect cons.<10 .mu.sec.fwdarw..rho.<10.sup.8/.di-elect cons-..sub.r .OMEGA.cm (4)

where .di-elect cons..sub.r is relative electric permittivity and .di-elect cons. is the electric permittivity of the resistive coating. In this way, the upper bound of resistivity has been determined according to at least one example.

Pulling this information together, it has been established that in at least some examples of the present disclosure, the resistivity factor of the resistive coating employed to suppress filamentary streamer discharge is expressed by the relationship, 10.sup.4<.rho..di-elect cons..sub.r<10.sup.8 (.OMEGA.cm) (5)

In other examples, the criteria for the lower and upper boundaries are extended to account for variations in the types of materials used, the target induced charge for the photoconductive imaging surface, the speed of the printer, etc., such that the resistivity factor employed to suppress filamentary streamer discharge is expressed by the relationship, 10.sup.3<.rho..di-elect cons..sub.r<10.sup.9 (.OMEGA.cm) (6)

Satisfying the electrical criteria for the resistive coating as described in the foregoing example model is a first condition, but not a sufficient condition, to suppress filamentary streamers according to at least some examples of the present disclosure. In one aspect, the dielectric thickness (t/.di-elect cons..sub.r) of the resistive coating also is subject to a threshold criterion derived from an analysis of electric fields present during an incipient discharge event in the air gap between resistive coating 406 and imaging surface 410 (FIG. 8). In general terms, a thickness of the resistive coating should be sufficient to limit the electric field in the air gap to a value lower than a value of an electric field which allows for self-propagation of filamentary streamers during its lifetime (e.g. 100 ns). The air gap field is a combination of the power supply field and the field associated with ionized gas and induced charge in the metal external surface (under the resistive coating) of the charge roller. In accordance with at least some examples of the present disclosure, suppression of filamentary streamers is realized when the air gap electric field limits the Townsend ionization coefficient shown in FIG. 7 such that .alpha.(E) d<20.

Among other potential factors, an appropriate thickness depends on the charging voltage and the volume of streamers to be suppressed. In one example, such as a printing system employing a 1000 Volt target charge density on its imaging surface, a 1600 Volt potential is created at the surface of the charge roller to achieve the target charge density at the imaging surface.

Figure 9:
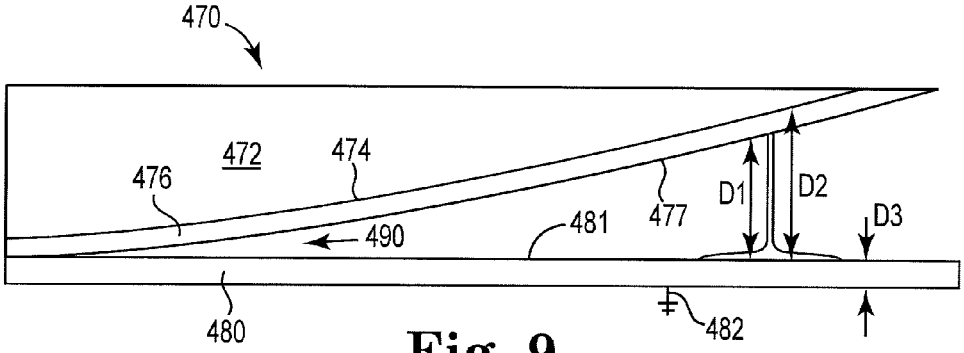
FIG. 9 is a side view schematically illustrating dimensional aspects of a filamentary streamer between a portion of a resistively-coated charge roller and an imaging surface, according to one example of the present disclosure.

As shown in FIG. 9, a charge roller 470 includes body 472, metal external surface 474, and resistive coating 476, with an imaging surface 481 in close proximity.

Based on the foregoing example models and with further reference to FIG. 9, given a 1600 Volt bias at the metal external surface 474 of the charge roller 470, a Paschen air breakdown would start occurring at a gap (D1) of 260 micrometers between the coating external surface 477 of the charge roller 470 and the imaging surface 481, as shown in at least FIG. 9. Meanwhile, the identifier D2 in FIG. 9 represents a distance between metal external surface 474 underneath the outer resistive coating 476 and the top of the imaging surface 481. Finally, the identifier D3 represents a physical thickness of photoconductive sheet 480 that defines imaging surface 481.

Accordingly, in one example model, to prevent filamentary streamer discharges from occurring at this location, the Townsend coefficient (.alpha.) would be expressed by the relationship, .alpha.<20/260 um=770 cm.sup.−1 (7)

Figure 7:
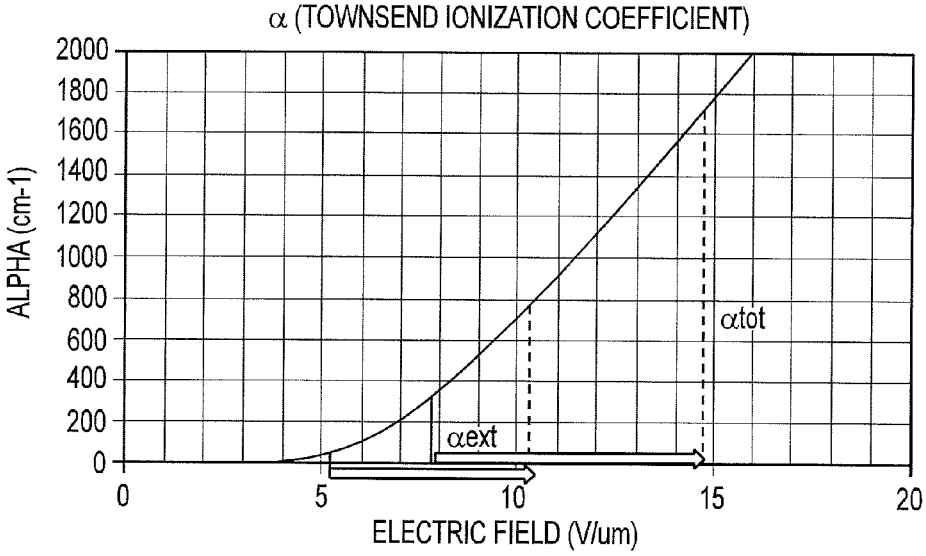
FIG. 7 is a graph schematically illustrating a Townsend ionization coefficient for a given magnitude of an electric field at atmospheric pressure, according to one example of the present disclosure.
Figure 8:
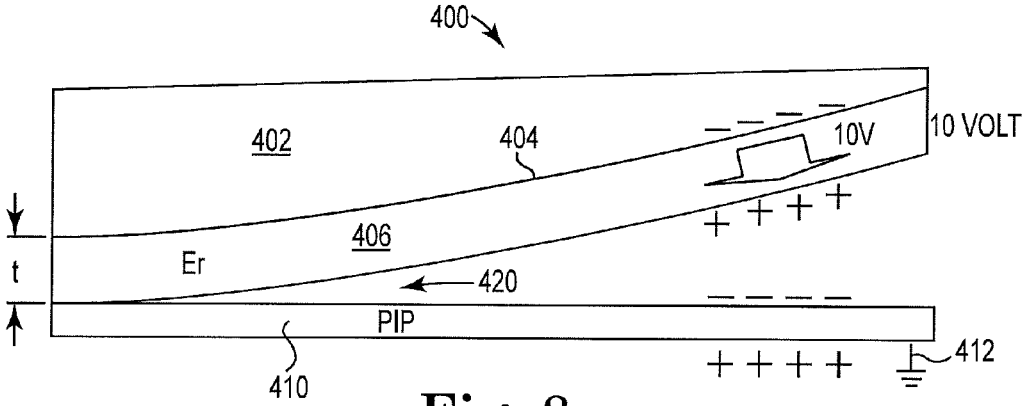
FIG. 8 is a side view schematically illustrating a portion of a resistively-coated charge roller in rolling contact with, and in charge transferring relation to, an imaging surface, according to one example of the present disclosure.

According to the Townsend ionization coefficient .alpha.(E) curve shown in FIG. 7, this relationship occurs when the electric field E=10.5 V/um. However, the filamentary streamer behavior becomes self-sustainable when the self-field of the filamentary streamer is generally equal to the external electric field. Therefore, an external field E=5.25 V/um would be the streamer threshold.

However, the electric field E produced by external power supply at 1600 V (applied to the metal external surface 474 of the charge roller 470) is 6 V/um at this location. Accordingly, this electric field can be reduced by increasing the gap between the two metal electrodes, namely, between the metal external surface 474 of the charge roller 470 and the ground 482 of the imaging surface 481 (such as the organic photoconductor (OPC) ground), as shown in FIG. 9. In one example according to the present disclosure, this gap is increased via the addition of a dielectric coating on the charge roller, such as the resistive coaling 476.

In one example, the target gap between the metal external surface 474 of the charge roller 470 and the imaging surface 481 is expressed via the relationship, New gap=(260 .mu.m+6 .mu.m).times.(6/5.25)=304 .mu.m, (8)

where a dielectric thickness of the organic photoconductive sheet 480 (e.g. the organic layer of the photoconductor) of 6 micrometers is included in the calculation, in which the dielectric constant of the photoconductive sheet 480 is 3 and the physical thickness (D3) of the photoconductive sheet 480 is 18 micrometers.

With this in mind, the extra 38 micrometers (calculated as 304−266) is the target dielectric thickness of the resistive coating 476 to prevent or substantially suppress filamentary streamers from being induced from the metal external surface 474 of the charge roller 470 underlying the resistive coating. Accordingly, D2 corresponds to a distance (e.g. 298 micrometers) or gap between the metal external surface 474 and the top of the photoconductive sheet 480 after the resistive coating (e.g. 38 micrometers thickness) has been added as an outer layer to the metal external surface 474 of the charge roller 470.

Accordingly, as demonstrated above, in at least some examples of the present disclosure, a resistive coating (e.g. resistive coating 476 in FIG. 9) is expected to provide generally complete suppression of filamentary streamer discharges. However, in some examples, a less than complete suppression of filamentary streamer discharges will still prevent or sufficiently minimize an alligator pattern in printing that would otherwise occur in the absence of the outer resistive coating made of an inorganic, non-polymeric material. Moreover, the amount of charge to be induced on an imaging surface of a photoconductive sheet (e.g. photoconductive sheet 480) of a given printing system can be less than 1000 Volts, such that less resistive coating is warranted to sufficiently suppress filamentary streamers to achieve charging the imaging surface in a glow discharge regime.

Accordingly, in some examples, the dielectric thickness (t/.di-elect cons..sub.r) of the inorganic, non-polymeric outer resistive coating is at least about 5 micrometers.

Based on the foregoing example model, this scenario is relevant for a time scale of 100 nanoseconds in which filamentary streamers are typically formed. For the time scale relevant for charging by glow discharge, a surface charge density sufficient to charge the photoconductive sheet (e.g. OPC) to 1000V is maintained at the resistive coating surface by applied charge roller power supply voltage of 1600V DC.

In view of the foregoing models and according to at least some examples of the present disclosure, further illustrations can be made for different materials with each applied as a resistive coating onto a metal external surface of a charge roller. In one example, the resistive coating may include a silicon carbide (SiC) material deposited by plasma-enhanced chemical vapor deposition (PECVD) and in another example, the resistive coating may include a Al.sub.2O.sub.3:TiO.sub.2 material deposited by plasma flame spray.

Figure 10:
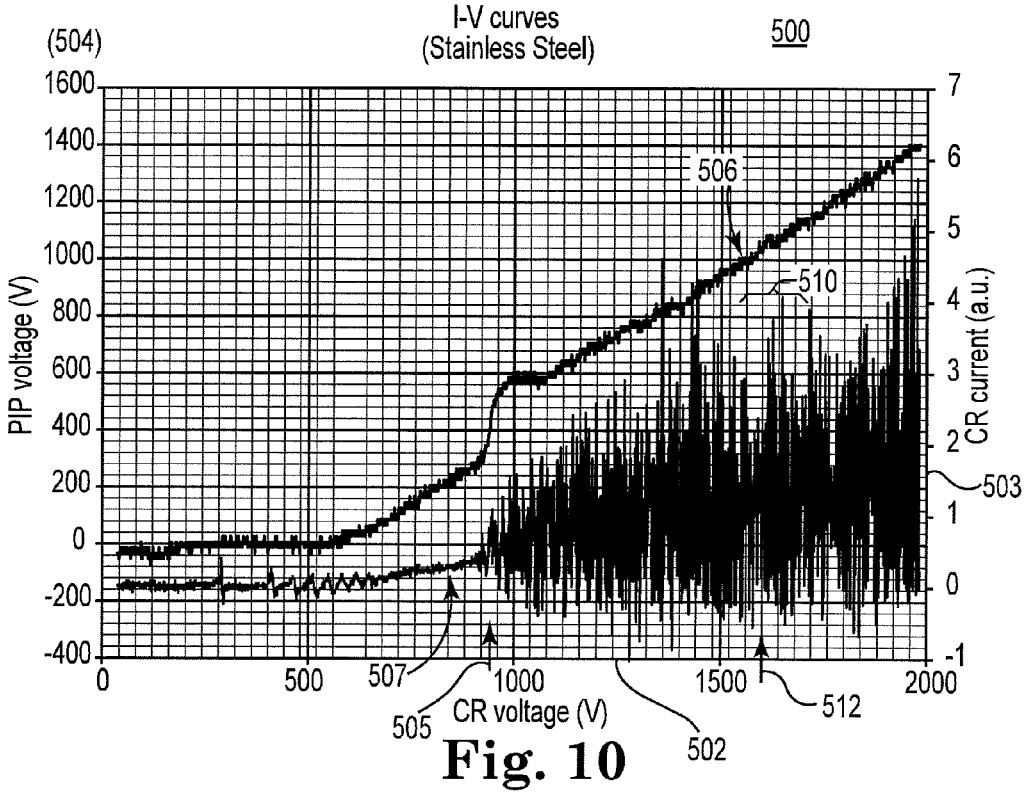
FIG. 10 is a graph schematically illustrating a current-voltage characteristic of a bare metal charge roller in charge-transferring relation with an imaging surface, according to one example of the present disclosure.
Figure 11:
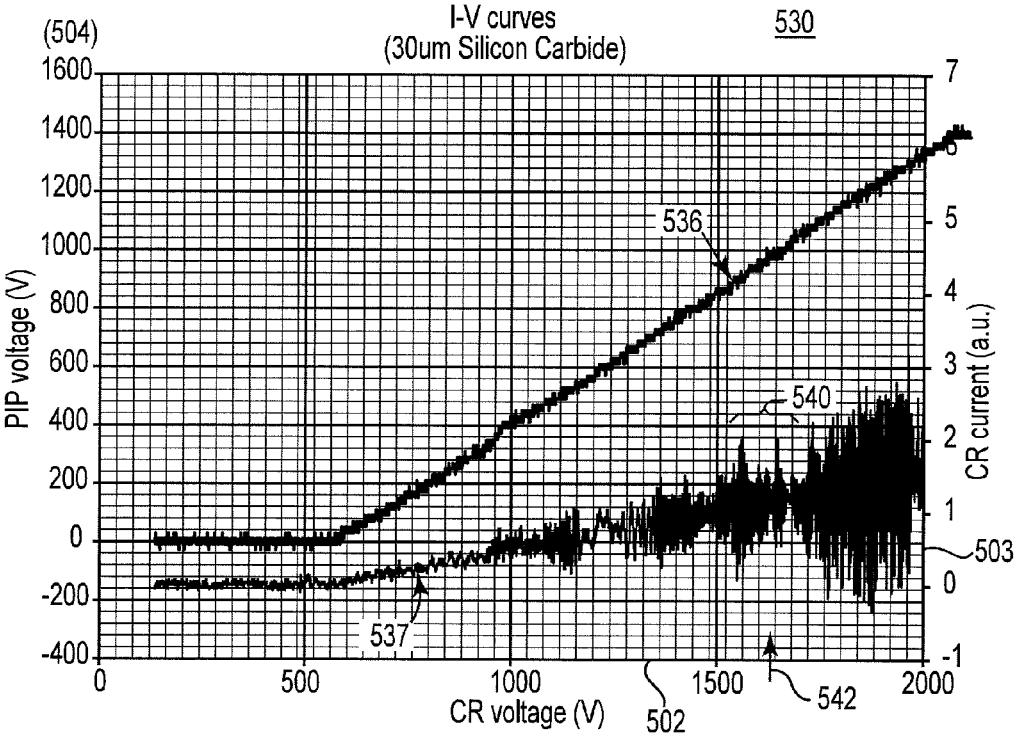
FIG. 11 is a graph schematically illustrating a current-voltage characteristic of a resistively-coated, metal charge roller in charge-transferring relation with an imaging surface, according to one example of the present disclosure.
Figure 12:
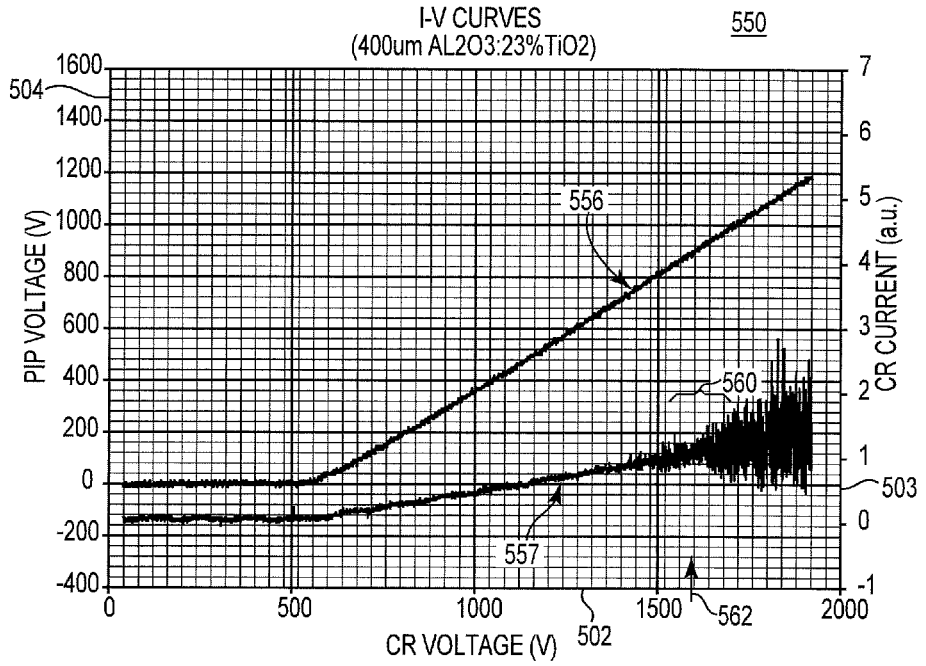
FIG. 12 is a graph schematically illustrating a current-voltage characteristic of a resistively-coated, metal charge roller in charge-transferring relation with an imaging surface, according to one example of the present disclosure.

With this in mind, FIGS. 10-12 include graphs of a current-voltage characteristic for a charge roller to schematically illustrate the intensity (amplitude and/or quantity) of filamentary streamer discharges depending on the type of resistive coating on top of the metal external surface of a charge roller.

FIG. 10 is a graph 500 schematically illustrating a current-voltage characteristic of a metal charge roller (CR) without a resistive coating when in charge-transferring relation to an imaging surface, such as during contact between the metal charge roller and the imaging surface. In this example, the bare metal external surface comprises stainless steel.

As shown in FIG. 10, as the potential difference between the metal charge roller and the ground of the imaging surface reaches about 940 volts (see arrow 505 along x-axis 502), the system begins exhibiting a pattern of large current fluctuations which is indicative of the formation and discharge of filamentary streamers. In general, the voltage potential that may push a metal charge roller into a streamer discharge behavior in a given printer system depends on various physical and other system parameters. Some printer systems use an imaging surface charged to about 1,000 volts with respect to ground for desired print operation. This is the case, for example, in some Indigo digital presses. The threshold at which streamer discharges (of a metal charge roller) occur in such an example system may be about 940 volts. However, a potential of about 1,600 volts on the metal charge roller with respect to the ground of the imaging surface may be employed to charge the imaging surface to a target of 1,000 volts. In traditional systems, this relationship may cause a significant filamentary streamer discharge behavior between a metal external surface of the charge roller and the imaging surface, as illustrated in FIG. 10.

As shown in the graph 500 of FIG. 10, a voltage signal 506 is plotted relative to a leftmost y-axis (504) and represents the voltage present at the imaging surface (indicated as PIP for photo imaging plate). The x-axis (502) corresponds to potential difference between a metal external surface of the charge roller (CR) and the ground of the imaging surface. Meanwhile, graph 500 also includes a current signal (as measurable by 10 kHz bandwidth current probe) 507 plotted relative to a rightmost y-axis (503) and that represents the behavior of the charging of imaging surface (for a given voltage potential between the metal external surface of the charge roller and the ground of the imaging surface).

Figure 13:
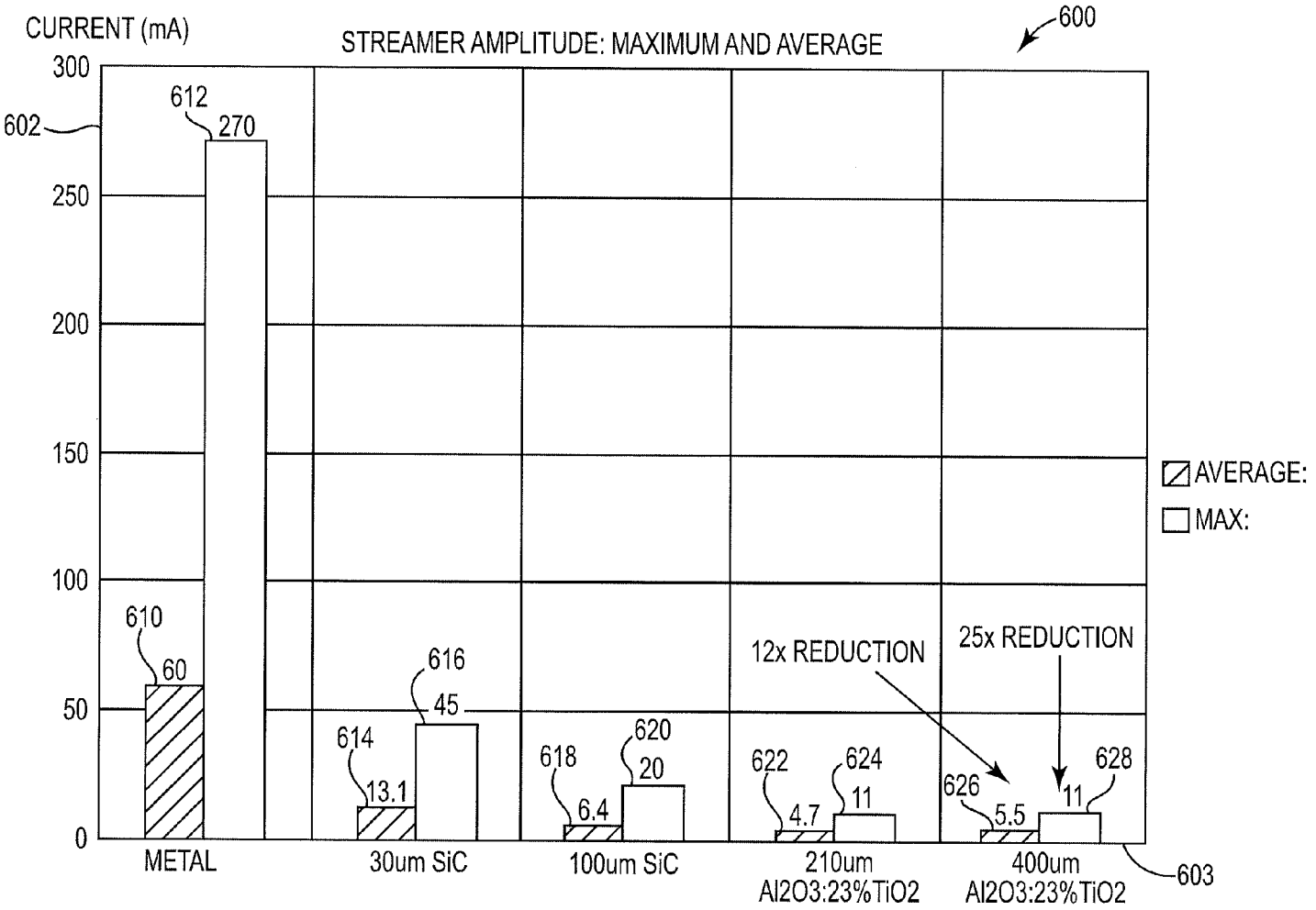
FIG. 13 is a column graph schematically illustrating an amplitude of filamentary streamer discharges for different types of resistive coatings for a metal external surface charge roller, according to one example of the present disclosure.

As shown in FIG. 10, as indicated by marker 510 at signal 507, when a potential difference between the charge roller and the imaging surface is 1600 Volts (arrow 512), many large amplitude filamentary streamer discharges may be present. As previously noted, this 1600 Volt potential difference corresponds to about 1000 Volts at the imaging surface (PIP) relative to ground. The maximum amplitude of the filamentary streamer discharges is about 270 mA, as shown in FIG. 13 where streamer amplitudes is measurable with 50 MHz bandwidth current probe. Further details regarding the amplitude and quantity of filamentary streamer discharges is described later in association with at least FIG. 13.

As can be understood via FIG. 10, providing a bare metal external surface of a charge roller may lead to high amplitude filamentary streamer discharges, which may lead to an alligator pattern in the prints due to non-uniform charge distribution in the imaging surface on the photoconductive sheet (e.g. photoconductive sheet 480 in FIG. 9) and may also lead to arcing in the photoconductive sheet due to its high charge density.

The following illustrates how some example charge rollers can be constructed and evaluated to meet at least some of such challenges.

One example charge roller includes a 30 micrometer thick, resistive coating of silicon carbide while another example charge roller includes a 100 micrometer thick resistive coating of silicon carbide. A dielectric constant of the silicon carbide measured to be about 6 may correspond to a dielectric thickness calculated to be Sum and 17 um, respectively, for the 30 .mu.m physical thickness and the 100 .mu.m physical thickness.

FIG. 11 is a graph 530 schematically illustrating a current-voltage characteristic for a charge roller having a 30 micrometer resistive coating of silicon carbide on its metal external surface. Graph 530 includes a voltage signal 536 plotted relative to a leftmost y-axis (504) of the voltage present at the imaging surface (indicated as PIP for photo imaging plate) and relative to an x-axis (502) corresponding to a bias voltage for a charge roller (CR). Meanwhile, graph 530 also includes a current signal 537 (measurable with a 10 kHz bandwidth current probe) plotted relative to a rightmost y-axis (503) and corresponding to the charges induced at imaging surface and relative to x-axis. As shown in FIG. 11, when a 1600 Voltage bias is present on the charge roller (arrow 542), some filamentary streamer discharges may also be present as indicate the current fluctuations in signal 537, as identified via marker 540. However, these filamentary streamer discharges identified by marker 540 in FIG. 11 may have much lower amplitude than the filamentary streamer discharges that the bare metal charge roller may exhibit (see marker 510 in FIG. 10). In this example of the present disclosure having a 30 micrometer silicon carbide outer resistive coating, the maximum amplitude of the filamentary streamer discharges is about 45 mA, as shown in FIG. 13 where streamer amplitudes are measurable with 50 MHz bandwidth current probe. This 45 mA maximum amplitude is about 6.times. lower than the maximum amplitude of filamentary streamer discharges that occur without a resistive coating (i.e. bare stainless steel) as represented by FIG. 10.

In another example of the present disclosure, charge rollers have a construction including an Al.sub.2O.sub.3: 23% TiO.sub.2 resistive coating at a thickness of 400 micrometers. Because an estimated dielectric constant of Al.sub.2O.sub.3:TiO.sub.2 is generally known to be about 15 in at least one example, a corresponding dielectric thickness was calculated to be about 27 micrometers for the 400 micrometer physical thickness.

FIG. 12 is a graph 550 schematically illustrating a current-voltage characteristic for a charge roller having a 400 micrometer resistive coating of Al2O3:TiO2 on its metal external surface. Graph 550 includes a voltage signal 556 plotted relative to a leftmost y-axis (504) of the voltage present at the imaging surface (indicated as PIP for photo imaging plate) and relative to an x-axis (502) corresponding to a bias voltage of the charge roller (CR). Meanwhile, graph 550 also includes a current signal (measurable with a 10 kHz bandwidth current probe) 557 plotted relative to a rightmost y-axis (503) and corresponding to the charges induced at imaging surface. As shown in FIG. 12, as identified via marker 560, when a 1600 Voltage bias is present at charge roller (arrow 562), some filamentary streamer discharges may be present. However, these filamentary streamer discharges identified via marker 560 in FIG. 12 may have a significantly lower amplitude than the filamentary streamer discharges (see marker 510 in FIG. 10) which may be exhibited by the bare metal charge roller previously shown in FIG. 10. In this example of the present disclosure of a 400 micrometer Al2O3:TiO2 outer resistive coating, the maximum amplitude of filamentary streamer discharges is 11 mA, as shown in FIG. 13 where streamer amplitudes are measurable by 50 MHz bandwidth current probe. This 11 mA maximum amplitude is 30.times. lower than the maximum amplitude of filamentary streamer discharges without a resistive coating (i.e. bare stainless steel) as shown in FIG. 10.

In another aspect, FIG. 12 further illustrates that with this example 400 micrometer resistive coating (made of a Al2O3:TiO2 material), the streamer threshold (i.e. the voltage at which streamers generally begin to occur) may be increased to about 1400V whereas the streamer threshold for the bare metal is much lower, at 900V. With this in mind, if a printer is employed that requires a 800V photoconductor voltage, the charge roller may be biased at 1400V, which is at or below the elevated streamer threshold demonstrated via FIG. 12. In this scenario, the example charge roller may not have any filamentary streamer discharges. Accordingly, in some examples the outer resistive coating can sufficiently raise the streamer threshold to a level that generally precludes streamer formation.

While not represented in FIGS. 10-12, other example charge rollers can be constructed according to the general principles of the examples of the present disclosure. Some information regarding these other example charge rollers are represented in FIGS. 13-16. Some of these other example charge rollers include one charge roller with a 100 micrometer thick resistive coating of silicon carbide material and one charge roller with a 210 micrometer thick resistive coating of Al.sub.2O.sub.3:TiO.sub.2 material.

Accordingly, FIGS. 13-16 further illustrate the relative effectiveness of the different resistive coatings for a metal external surface charge roller, according to at least some examples of the present disclosure. FIG. 13 is a graph 600 schematically illustrating the amplitude of filamentary streamer discharges (expressed as current) occurring when 1600 Volt is present at the metal external surface of the charge roller for a given resistive coating. FIG. 13 includes a y-axis (602) representing the charges present at the imaging surface as current (mA) while the x-axis (603) designates each type of resistive coating on a metal external surface of a charge roller.

As shown in FIG. 13, for a bare metal charge roller that omits a resistive coating from its metal external surface (identified as "metal" along x-axis 603), the average amplitude of filamentary streamer discharges is about 60 mA (column 610) and maximum amplitude of filamentary streamer discharges is about 270 mA (column 612). In one aspect, the bare metal surface is made of stainless steel.

As further shown in FIG. 13, for a 30 micrometer thick resistive coating of silicon carbide ("30 .mu.m SiC" along x-axis 603), the average amplitude of filamentary streamer discharges may be about 13.1 mA (column 614) and a maximum amplitude of filamentary streamer discharges may be about 45 mA (column 616). As further shown in FIG. 13, for a 100 micrometer thick resistive coating of silicon carbide ("ground 100 .mu.m SiC" along x-axis 603), the average amplitude of filamentary streamer discharges may be about 6.4 mA (column 618) and a maximum amplitude of filamentary streamer discharges is about 22 mA (column 620). As further shown in FIG. 13, for a 210 micrometer thick resistive coating of aluminum oxide:titanium oxide ("210 .mu.m Al2O3:23% TiO2" along x-axis 603), the average amplitude of filamentary streamer discharges may be about 4.7 mA (column 622) and a maximum amplitude of filamentary streamer discharges may be about 12 mA (column 624).

Finally, as further shown in FIG. 13, for a 400 micrometer thick resistive coating of aluminum oxide:titanium oxide ("420 .mu.m Al2O3:23% TiO2" along x-axis 603), the average amplitude of filamentary streamer discharges may be about 5.5 mA (column 626) and a maximum amplitude of filamentary streamer discharges is about 11 mA (column 628).

Accordingly, by providing a resistive coating of a semiconductor material (e.g. SiC) or an insulator with electrically active defect states (e.g., Al2O3:23% TiO2) on top of a metal external surface of a charge roller, maximum amplitudes of filamentary streamer discharges are suppressed substantially. At the least, the maximum amplitude of filamentary streamer discharges is suppressed substantially by a factor of 5-6, such as can be demonstrated via the 30 micrometer resistive coating of silicon carbide that has a dielectric thickness (t/.di-elect cons..sub.r) about that of the photoconductor.

In some examples, the maximum amplitude of filamentary streamer discharges can be reduced by even greater amounts, and even by a factor of 25 (e.g. 400 micrometer coating of Al2O3:TiO2), as represented by column 628. Accordingly, in some instances, the amplitude of filamentary streamer discharges is reduced by at least one order of magnitude.

These examples illustrate that a permanent metal charge roller can be used to apply a charge to an imaging surface in an electrophotography system without compromising print quality due to filamentary streamer discharges, which might otherwise produce alligator patterns in printing (but for the presence of the resistive coatings on the metal external surface of the charge rollers). Moreover, the resistive coatings are at least as hard as the underlying metal external surface. This feature ensures print quality because it will be very difficult to dent or nick the very hard surface of the charge roller provided by the resistive coating on the relatively hard underlying metal external surface. Consequently, because of its hardness, the metal charge roller is expected to provide substantially increased longevity in use in a high speed digital printing system. Moreover, the previously described electrical stability and/or chemical stability of the outer resistive coating further contributes to the longevity of a charge roller, according to at least some examples of the present disclosure.

Accordingly, in one example of the present disclosure, reducing the maximum amplitude of the filamentary streamer discharges is a target achieved by the presence of the resistive coating, as demonstrated in association with at least FIGS. 10-13.

Figure 14:
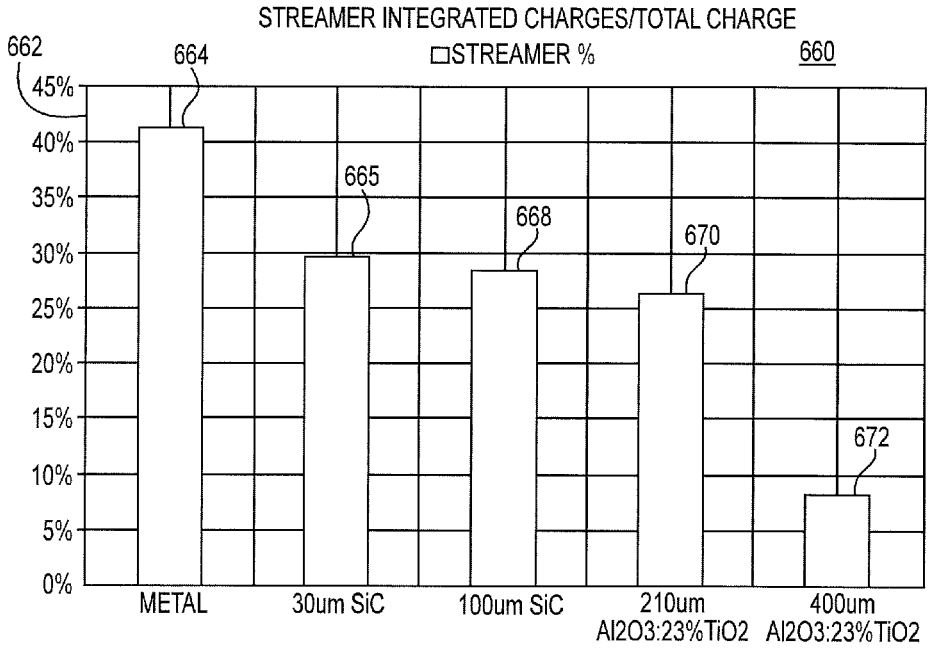
FIG. 14 is a column graph schematically illustrating a percentage of filamentary streamer-based charges relative to the total charges on an imaging surface laid down by charge rollers with different types of resistive coatings, according to one example of the present disclosure.

FIG. 14 is a graph 660 depicting, for a given type of resistive coating according to examples of the present disclosure, a percentage of charges deposited under DC excitation on a photoconductor (e.g. imaging surface) by filamentary streamers relative to the overall charge present on the photoconductor. FIG. 14 includes a y-axis (662) representing the percentage of charges (in units of Coulomb) at the imaging surface while, for each column appearing along the x-axis, each type of resistive coating is designated.

As shown in FIG. 14, column 664 corresponds to a charge roller omitting a resistive coating from its metal external surface ("metal") and for which filamentary streamer discharges may comprise about 42 percent of the total charge on the surface of the photoconductor (e.g. imaging surface). Column 665 of graph 660 corresponds to a charge roller having a 30 micrometer thick resistive coating of silicon carbide on its metal external surface ("30 .mu.m SiC") and for which filamentary streamer discharges may comprise about 29 percent of the total charge on the photoconductor. Column 668 of graph 660 corresponds to a 100 micrometer thick resistive coating of silicon carbide ("100 .mu.m SiC") and for which filamentary streamer discharges may comprise about 27 percent of the total charge on the photoconductor. Column 670 of graph 660 corresponds to a 210 micrometer thick resistive coating of aluminum oxide:titanium oxide ("210 .mu.m Al2O3:23% TiO2") and for which filamentary streamer charges may comprise about 26 percent of the total charge on the photoconductor. Finally, column 672 of graph 660 corresponds to a 400 micrometer thick resistive coating of aluminum oxide:titanium oxide ("420 .mu.m Al2O3:23% TiO2") and for which filamentary streamer discharges may comprise about 8 percent of the total charge on the surface of the photoconductor.

Accordingly, in at least some examples as illustrated via FIG. 14, reducing the percentage of total charge contributed by filamentary streamer discharges is a target behavior achieved by the presence of the resistive coating.

Furthermore, in performing printing examples using the above-described example charge rollers, such as the charge roller including the 100 micrometer silicon carbide coating and the charge roller having the 210 micrometer Al.sub.2O.sub.3:TiO.sub.2 coating, it can be observed that target printing quality is achievable in which substantially no alligator markings are produced by a digital press.

Figure 15:
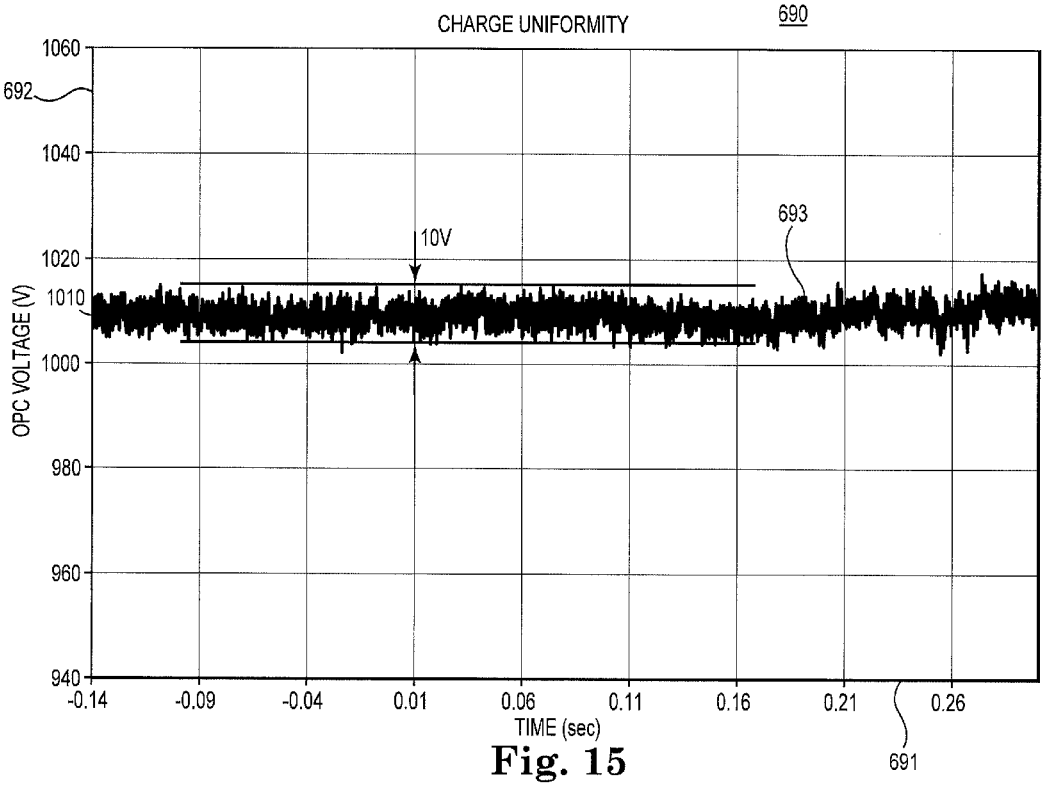
FIG. 15 is a graph schematically illustrating a charge uniformity on a photoconductor for a given type of resistive coating on a charge roller, according to one example of the present disclosure.

Moreover, it can be further observed in some examples that the charge uniformity producible by the tested charge rollers (having a resistive coating on their metal external surface) can be <10V, as shown in FIG. 15. In particular, FIG. 15 is a graph 690 schematically illustrating a charge at an imaging surface producible by a charge roller having a resistive coating of aluminum oxide:titanium oxide. As shown in FIG. 15, via y-axis 692, the graph 690 plots a voltage (signal 693) at the imaging surface (i.e. photo imaging plate—PIP) as a function of time (x-axis 691), which in turn can be translated into distance by multiplying speed of the printer (2 m/s). In one example, with a gap of 38 micrometers, and an example resistive coating made of Al2O3:TiO2 (400 .mu.m thickness), FIG. 15 illustrates that the voltage (693) generally varies by less than 10 Volts. This behavior corresponds to a high degree of charge uniformity on the imaging surface and is indicative of vigorous suppression of filamentary streamers.

Figure 16:
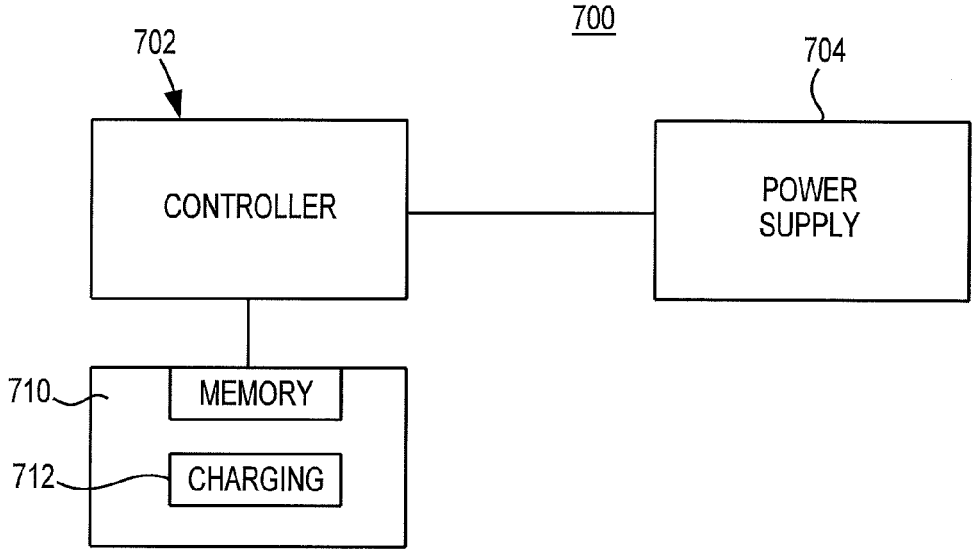
FIG. 16 is a block diagram schematically illustrating a controller and a computer readable memory than can be used to operate a printing system, according to an example of the present disclosure.

FIG. 16 is a block diagram schematically illustrating a control portion 700 of a printing system, according to an example of the present disclosure. As shown in FIG. 16, the control portion 700 includes a controller 702, a memory 710, and a power supply 704, such as one of the power supplies 106 and 321, as previously described in association with FIGS. 1 and 6, respectively.

In general terms, controller 702 of control portion 700 comprises at least one processor and associated memories that are in communication with memory 710 to generate control signals directing operation of at least some components of the systems and components previously described in association with at least FIGS. 1-15, including directing operation of power supply 704. In particular, in response to or based upon commands received via a user interface and/or machine readable instructions (including software), such as charging module 712 contained in the memory 710, controller 702 generates control signals directing operation of power supply 704 in accordance with at least some of the previously described examples of the present disclosure. In one example, controller 702 is embodied in a general purpose computer and communicates with a printing system while in other examples, controller 702 is incorporated within the printing system.

For purposes of this application, in reference to the controller 702, the term "processor" shall mean a presently developed or future developed processor (or processing resources) that executes sequences of machine readable instructions (such as but not limited to software) contained in a memory. Execution of the sequences of machine readable instructions, such as those provided via charging module 712, causes the processor to perform actions, such as operating controller 702 to provide a generally uniform charge distribution on an imaging surface in a manner generally described in at least some examples of the present disclosure. The machine readable instructions may be loaded in a random access memory (RAM) for execution by the processor from their stored location in a read only memory (ROM), a mass storage device, or some other persistent storage or non-volatile form of memory, as represented by memory 710. In one example, memory 710 comprises a computer readable medium providing non-volatile storage of the machine readable instructions executable by a process of controller 702. In other examples, hard wired circuitry may be used in place of or in combination with machine readable instructions (including software) to implement the functions described. For example, controller 102 may be embodied as part of at least one application-specific integrated circuit (ASIC). In at least some examples, the controller 702 is not limited to any specific combination of hardware circuitry and machine readable instructions (including software), nor limited to any particular source for the machine readable instructions executed by the controller 702.

Figure 17:
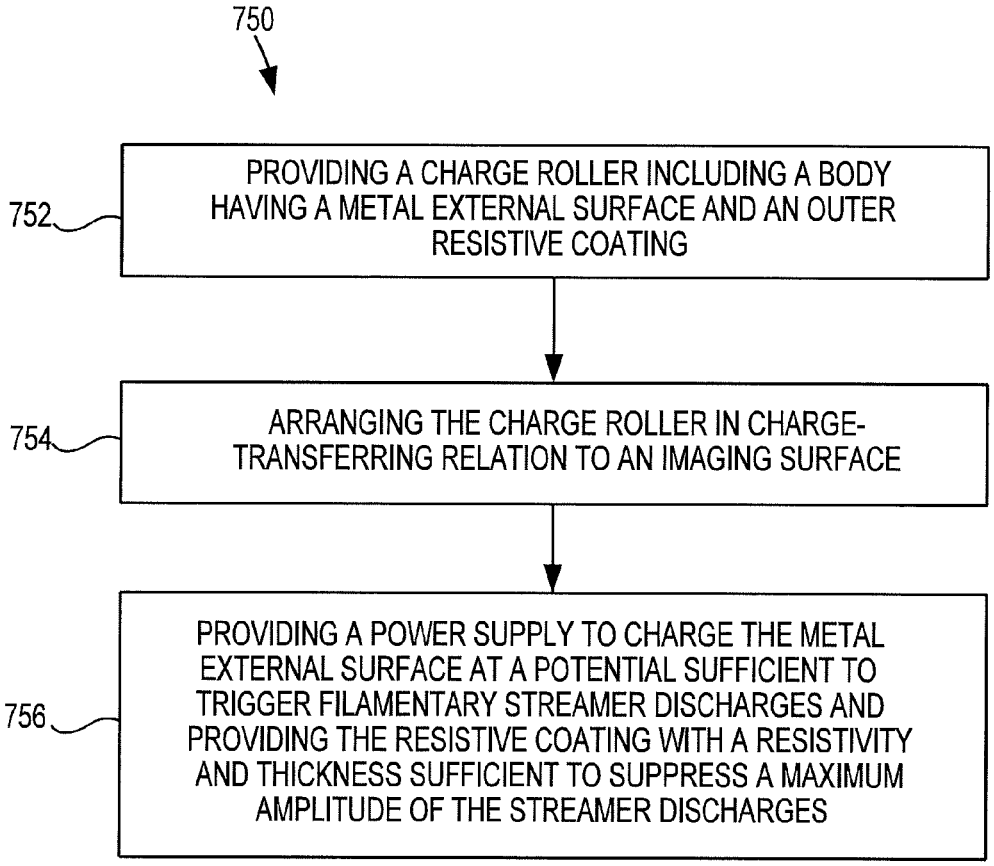
FIG. 17 is a flow diagram schematically illustrating a method of manufacturing a printing system, according to an example of the present disclosure.

FIG. 17 is a flow diagram schematically illustrating a method 750 of manufacturing a liquid electrophotographic printer, according to at least one example of the present disclosure. In one example, method 750 is performed via the components, features, modules, and systems previously described in association with FIGS. 1-16. As shown at 752 in FIG. 16, method 750 includes providing a charge roller including a body having a metal external surface and an outer resistive coating directly overlying the metal external surface. As previously described, in some examples the outer resistive coating is made of an inorganic, non-polymeric material. At 754, method 750 includes arranging the charge roller in charge transferring relation to an imaging surface. As shown at 756 in FIG. 17, in method 750 a power supply is provided to charge the metal external surface (of the body of the charge roller) at a potential sufficient to trigger filamentary streamer discharges between the charge roller and the imaging surface while the inorganic resistive layer has a resistivity and thickness sufficient to generally suppress a maximum amplitude of the filamentary streamer discharges. In some examples, the outer resistive layer suppresses the maximum amplitude of the filamentary streamer discharges by a factor of at least 2. In other examples, resistive layer suppresses the maximum amplitude of the filamentary streamer discharges by a factor of about 3 to about 10. In other examples, resistive layer suppresses the maximum amplitude of the filamentary streamer discharges by a factor of about 5 to about 10. In other examples, resistive layer suppresses the maximum amplitude of the filamentary streamer discharges by a factor of about 10 to about 25. In other examples, resistive layer suppresses the maximum amplitude of the filamentary streamer discharges by a factor of at least about 25.

In some examples of the present disclosure, a charge roller includes a metal external surface and a resistive coating overlying the metal external surface. In one aspect, the charge roller is positionable in charge-transferring relation to an imaging surface. The hardness of the metal external surface and the hardness of the overlying resistive coating work together to contribute to a relative "permanency" of the charge roller within a printing system. Additionally, electrical and chemical stability of the resistive coating in the environment of a printing system contributes to permanency of the disclosed charge roller. This permanency can dramatically reduce costs and downtime associated with replacing traditional charge rollers. The ability to employ metal charge rollers stems, at least in part, from the ability of the resistive coating to significantly suppress a maximum amplitude and/or total integrated charges of filamentary streamers that would otherwise be produced from a bare metal external surface of a charge roller.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. An electrophotographic printing system comprising:

a charging unit including a charge roller in charge-transferring relation to charge an imaging surface prior to formation of an electrostatic latent image on the imaging surface, the charge roller comprising a body having a metal external surface and an outer resistive inorganic, non-polymeric layer, wherein the outer resistive inorganic, non-polymeric layer is made solely from a semiconductor material chosen from silicon carbide, silicon, and hydrogenated silicon.

2. The printing system of claim 1, wherein the outer resistive inorganic, non-polymeric layer has a resistivity factor greater than $10^3$ Ohm-cm and less than about $10^9$ Ohm-cm.

3. The printing system of claim 1, wherein the charge roller is positionable to be spaced apart by a fixed air gap from the imaging surface during operation.

4. The printing system of claim 1, wherein the charge roller is positionable into rotatable, direct physical contact with the imaging surface during operation.

5. A charge roller in charge-transferring relation to an imaging surface of a liquid electrophotographic printing system, the charge roller comprising:

a body having a metal external surface and an overlying resistive coating made of an inorganic, non-polymeric material, wherein a resistivity factor of the overlying resistive coating is expressed as $\rho \cdot \varepsilon_r$, wherein $\varepsilon_r$ is a dielectric constant, wherein p is resistivity, wherein t is a thickness of the resistive coating, and wherein $t/\varepsilon_r > 5$ micrometers.

6. The charge roller of claim 5, the overlying inorganic resistive coating to induce a substantially uniform charge on the imaging surface via a substantial reduction of filamentary streamers.

7. The charge roller of claim 5, wherein the charge roller is a non-consumable component of the electrographic printing system.

8. The charge roller of claim 5, wherein the inorganic, non-polymeric material includes a semiconductor material.

9. The charge roller of claim 8, wherein the semiconductor material comprises titanium oxide.

10. The charge roller of claim 5, wherein the inorganic, non-polymeric material is made solely of an insulator material with electrically active defect states.

11. The charge roller of claim 5, wherein the overlying resistive coating has a hardness at least substantially the same as a hardness of the metal external surface of the body of the charge roller.

12. The charge roller of claim 5, wherein the inorganic, non-polymeric material is substantially harder than the metal external surface of the body of the charge roller.

13. The charge roller of claim 12, wherein the substantially harder inorganic, non-polymeric material has a hardness at least one order of magnitude greater than a hardness of the metal external surface of the body of the charge roller.

14. The charge roller of claim 5, wherein the overlying resistive coating has a resistivity factor greater than $10^3$ Ohm-cm and less than about $10^9$ Ohm-cm.

15. An electrophotographic printing system comprising:

a charging unit including a charge roller in charge-transferring relation to an imaging surface and including a body having a metal external surface and an outer inorganic resistive layer, wherein the outer inorganic resistive layer has a resistivity factor greater than $10^3$ Ohm-cm and less than about $10^9$ Ohm-cm, and wherein the resistivity factor is expressed as $\rho \cdot \varepsilon_r$, wherein $\varepsilon_r$ is a dielectric constant, wherein $\rho$ is resistivity, wherein t is a thickness of the resistive coating, and wherein $t/\varepsilon_r > 5$ micrometers.

* * * * *